US009159302B2

(12) United States Patent
Jones et al.

(10) Patent No.: US 9,159,302 B2
(45) Date of Patent: Oct. 13, 2015

(54) PIANO EXTENDED SOFT PEDAL/CIP

(71) Applicant: Steinway Musical Instruments, Inc., Waltham, MA (US)

(72) Inventors: Marvin Scott Jones, State College, PA (US); Sue Guan Lim, Bayside, NY (US); Susan Yake Kenagy, Dix Hills, NY (US)

(73) Assignee: Steinway Musical Instruments, Inc., Waltham, MA (US)

( * ) Notice: Subject to any disclaimer, the term of this patent is extended or adjusted under 35 U.S.C. 154(b) by 0 days.

(21) Appl. No.: 14/496,578

(22) Filed: Sep. 25, 2014

(65) Prior Publication Data

US 2015/0096425 A1 Apr. 9, 2015

Related U.S. Application Data

(63) Continuation-in-part of application No. 14/045,088, filed on Oct. 3, 2013, now Pat. No. 8,927,835.

(51) Int. Cl.

| | |
|---|---|
| ***G10C 3/26*** | (2006.01) |
| ***G10C 1/02*** | (2006.01) |
| ***G10C 3/16*** | (2006.01) |

(52) U.S. Cl.

CPC .. *G10C 3/26* (2013.01); *G10C 1/02* (2013.01); *G10C 3/161* (2013.01)

(58) Field of Classification Search

CPC ..... G10C 3/26; G10C 3/161

See application file for complete search history.

(56) References Cited

U.S. PATENT DOCUMENTS

| | | | | | |
|---|---|---|---|---|---|
| 519,611 | A | | 5/1894 | Maurer | |
| 533,469 | A | * | 2/1895 | Jacobi | 84/242 |
| 608,177 | A | * | 8/1898 | Cobb | 84/219 |
| 747,790 | A | * | 12/1903 | Soper | 84/222 |
| 758,894 | A | * | 5/1904 | Bornheoft | 84/222 |
| 770,568 | A | * | 9/1904 | Engelhardt | 84/222 |
| 788,203 | A | * | 4/1905 | Glatt | 84/222 |
| 794,515 | A | * | 7/1905 | Kreter | 84/222 |
| 803,752 | A | * | 11/1905 | Glatt | 84/222 |
| 808,190 | A | | 12/1905 | Bothner | |
| 812,705 | A | | 2/1906 | Vogel et al. | |
| 828,460 | A | * | 8/1906 | Clark | 84/219 |
| 845,565 | A | | 2/1907 | Metzger | |
| 952,550 | A | * | 3/1910 | Vough | 84/222 |

(Continued)

OTHER PUBLICATIONS

International Search Report and Written Opinion; PCT/US2014/058740; Jan. 7, 2015; 15 pp.

(Continued)

*Primary Examiner* — Robert W Horn

(74) *Attorney, Agent, or Firm* — Fish & Richardson P.C.

(57) ABSTRACT

A piano selectively playable in normal and soft modes has multiple piano keys and actions, including a wippen assembly, and multiple piano hammers. A soft pedal system includes a soft pedal and a hammer rest rail mounted for movement between normal and soft mode positions. A piano key lift rail is mounted for movement between a normal mode position spaced from lifting contact with the keys and a soft mode position in contact with and lifting the keys and the wippen assemblies. A soft pedal linkage assembly between the soft pedal and the hammer rest rail and piano key lift rail, upon actuation of the soft pedal, causes movement of hammer rest rail and piano hammers, and movement of the piano keys and the wippen assemblies, between normal and soft mode positions, in gap-closing motion.

23 Claims, 22 Drawing Sheets

(56) References Cited

U.S. PATENT DOCUMENTS

| | | | | | |
|---|---|---|---|---|---|
| 963,837 | A | | 7/1910 | Vogel et al. | |
| 1,353,645 | A | | 9/1920 | George | |
| 1,368,107 | A | | 2/1921 | Braunsdorf | |
| 1,518,483 | A | | 12/1924 | Conner | |
| 1,528,113 | A | * | 3/1925 | Klepac | 84/223 |
| 1,639,241 | A | | 8/1927 | Veaco | |
| 1,729,198 | A | * | 9/1929 | Williams et al. | 84/219 |
| 2,146,114 | A | | 2/1939 | Finholm | |
| 2,482,619 | A | * | 9/1949 | Howe | 84/223 |
| 4,381,691 | A | | 5/1983 | Conklin, Jr. et al. | |
| 4,383,464 | A | | 5/1983 | Brennan | |
| 5,125,309 | A | | 6/1992 | Stanwood | |
| 5,287,787 | A | | 2/1994 | Inoue | |
| 7,858,858 | B2 | | 12/2010 | Eitaki et al. | |
| 8,541,671 | B1 | | 9/2013 | Burgett et al. | |
| 8,895,822 | B2 | | 11/2014 | Fujii | |
| 8,927,835 | B1 | * | 1/2015 | Jones et al. | 84/216 |
| 2013/0205969 | A1 | | 8/2013 | Fujii | |
| 2014/0311314 | A1 | | 10/2014 | Rawson | |

OTHER PUBLICATIONS

International Search Report and Written Opinion; PCT/US2014/056304; Dec. 31, 2014; 17 pp.

* cited by examiner

PIANO EXTENDED SOFT PEDAL/CIP

PRIORITY CLAIM

This application is a continuation-in-part of U.S. application Ser. No. 14/045,088, filed Oct. 3, 2013, now pending, the entire disclosure of which is incorporated herein by reference.

TECHNICAL FIELD

This invention relates to upright or vertical pianos, and, in particular, to soft pedal assemblies of such pianos.

BACKGROUND

An acoustic piano employs various systems for transmitting energy from a finger or actuator input force into an auditory, vibrational force. The transmission system, commonly called the "piano action", or "action", is a network of levers, cushions and hammers that accepts finger/actuator input force through a collection of pivotal levers, known as piano keys, or keys. The piano keys and piano actions focus this input force into rotating hammers of proportional density that are positioned to strike against tensioned wire strings. The piano hammers and their corresponding piano strings are both carefully constructed to match their acoustic properties, resulting in a tapered or graduated "scale" of components that cumulatively produce a multiple note span of musical frequencies. The piano strings act as media through which vibrational energy is transferred into an amplifier such as a soundboard, or electric speaker, where it ultimately is converted into audible sound.

Pianos can produce a wide range of volumes. Larger pianos can further expand this range to include very loud sounds, such as heard in concert pianos that are expected to broadcast over an accompanying orchestra without the assistance of electronic amplification. Pianos are present in many households, schools, institutions, etc. Inevitably, this proximity of sound-producing instruments creates situations where sound control and reduction are necessary. Many piano manufacturers offer pianos with sound level reducing mechanisms that selectively restrict level of volume. In upright or vertical pianos, these mechanisms typically include a rail that can be actuated to shift the rest position of the piano hammers relative to the strings, moving the hammers closer to the strings so that the hammers strike the strings with less kinetic energy. This type of soft pedal rail or hammer rest rail reduces the piano volume to a level of sound calculated to avoid disruption of neighboring environments such as apartments, practice rooms, etc.

SUMMARY

According to one aspect of the disclosure, a piano selectively playable in a normal mode and in a soft mode comprises: a set of multiple piano keys; a set of multiple piano actions associated with the multiple piano keys, each piano action including a piano wippen assembly actuated by depression of a corresponding piano key; a set of multiple piano hammers, each piano hammer mounted for rotating movement and defining a forward throw direction toward at least one corresponding piano string, each piano hammer being driven by a corresponding piano wippen assembly to transfer force applied to an associated piano key; a soft pedal system, the soft pedal system comprising: a soft pedal; a hammer rest rail mounted for movement between a normal mode position with said set of multiple piano hammers disposed at rest at a spaced distance from corresponding piano strings, and a soft mode position with the set of multiple piano hammers moved into at rest positions relatively closer to the corresponding piano strings; a piano key lift rail mounted for movement between a normal mode position spaced from lifting contact with piano keys of the set of multiple piano keys and a soft mode position disposed in contact with and lifting the piano keys along with the piano wippen assemblies; and a soft pedal linkage assembly in communication between the soft pedal and the hammer rest rail and the piano key lift rail, wherein actuation of the soft pedal causes movement of said hammer rest rail, along with the piano hammers, and causes movement of the piano keys, along with the piano wippen assemblies, between the normal mode position and the soft mode position, in gap-closing motion.

Pianos of the disclosure may further include one or more of the following implementations. For example, the soft pedal linkage assembly comprises: a generally horizontal soft pedal trap lever, a hammer rest rail rod, and a piano key lift rail rod. The hammer rest rail rod and the piano key lift rail rod are mounted in succession along the soft pedal trap lever. Preferably, the hammer rest rail rod and the piano key lift rail rod are mounted generally in parallel along the soft pedal trap lever. Actuation of the soft pedal lifts the hammer rest rail and the piano key lift rail. Preferably, the piano key lift rail rod comprises a linkage adjustable for length. In particular implementations, the linkage adjustable for length comprises a coaxial screw and a locking mechanism, and the linkage adjustable for length is independently adjustable relative to length of the hammer rest rail lift rod. The piano key lift rail, upon actuation, is disposed in lifting engagement with a rear undersurface of piano keys of the set of multiple piano keys. The piano key lift rail is mounted for pivoting movement between its normal mode position spaced from engagement with piano keys of the set of multiple piano keys and its soft mode position in lifting engagement with piano keys of the set of multiple piano keys. The piano key lift rail is mounted at at least two pivot points (fulcrums), e.g., three, four, five, etc. pivot points or fulcrums may be employed. The piano key lift rail is inflexible. The piano key lift rail in soft play mode is positioned for movement into engagement with piano keys of the set of multiple piano keys by linear motion, or by rotational motion. The piano key lift rail engages piano keys of the set of multiple piano keys by spring force, magnetic force, or electromechanical force. The piano further comprises a set of multiple bridle strap and bridle wire combinations, each bridle strap and bridle wire combination connecting a piano hammer to a corresponding piano wippen assembly, wherein actuation of the soft pedal tensions each bridle strap and bridle wire combination to lift an associated piano wippen assembly along with an associated piano hammer in the gap closing motion. Preferably, tensioning of at least one of the bridle strap and bridle wire combinations comprises shortening at least one of the bridle strap and the bridle wire, or tensioning of at least one of the bridle strap and bridle wire combinations comprises bending an upper end of the bridle wire below the bridle strap or by relocating the entire bridle wire.

According to another aspect of the invention, a piano playable in at least a normal mode comprises a set of multiple piano keys; a set of multiple piano actions associated with the multiple piano keys, each piano action including a piano wippen assembly actuated by depression of a corresponding piano key; a set of multiple piano hammers, each piano hammer mounted for rotating movement and defining a forward throw direction toward at least one corresponding piano string, each piano hammer being driven by a corresponding piano wippen assembly to transfer force applied to an associated piano key; and a set of multiple bridle strap and bridle wire combinations, each bridle strap and bridle wire combination connecting a piano hammer to a corresponding piano wippen assembly, wherein the bridle strap and the bridle wire combination is mounted and adjusted to maintain the hammer assembly and the corresponding wippen assembly together in gap-minimizing motion when an associated piano key is played.

Preferred embodiments of this aspect of the invention may include the following features.

The piano is selectively playable in normal mode and in soft mode, and further comprises a soft pedal system comprising a soft pedal; a hammer rest rail mounted for movement between a normal mode position with the set of multiple piano hammers disposed at rest at a spaced distance from corresponding piano strings, and a soft mode position with the set of multiple piano hammers moved into at rest positions relatively closer to the corresponding the piano strings; a piano key lift rail mounted for movement between a normal mode position spaced from lifting contact with piano keys of the set of multiple piano keys and a soft mode position disposed in contact with and lifting the piano keys along with the piano wippen assemblies; and a soft pedal linkage assembly in communication between the soft pedal and the hammer rest rail and the piano key lift rail, wherein actuation of the soft pedal causes movement of the hammer rest rail, along with the piano hammers, and causes movement of the piano keys, along with the piano wippen assemblies, between the normal mode position and the soft mode position, in gap-closing motion.

This disclosure thus provides improved upright or vertical pianos selectively playable in normal mode and in soft mode, with a soft pedal system that close the gaps inherently experienced with upright or vertical pianos, e.g. between the butt assembly and the jack of the piano action and/or between the wippen assembly and the capstan (or screw at the rear end of the piano key that contacts the wippen assembly), resulting in significant improvement in the situation of the unwanted touch sensation of "lost motion" experienced during piano playing. In some implementations, a tensioned bridle strap and bridle wire combination may additionally be employed.

Objectives of this disclosure include providing an upright or vertical piano in which gaps in the piano action causing undesirable touch sensation of "lost motion" for the piano player are reduced or eliminated. In one implementation, the objectives may be are achieved with use of a soft pedal system having a soft pedal that actuates a hammer rest rail mounted for movement between a normal mode position, with a set of multiple piano hammers disposed at rest at a spaced distance from corresponding piano strings, and a soft mode position, with the set of multiple piano hammers moved into at rest positions relatively closer to the corresponding piano strings; and that actuates a piano key lift rail mounted for movement between a normal mode position spaced from lifting contact with piano keys and a soft mode position disposed in contact with and lifting the piano keys along with the piano wippen assemblies. A soft pedal linkage assembly in communication between the pedal and the hammer rest rail and piano key lift rail, upon actuation of the soft pedal, causes movement of the hammer rest rail, along with the piano hammers, and causes movement of the piano key lift rail, along with the piano keys and the piano wippen assemblies, between the normal mode position and the soft mode position, in gap-closing motion.

In combination with the above implementation, or in another, separate implementation, e.g. in a piano playable in at least a normal mode, gaps in the piano action causing undesirable touch sensation of "lost motion" for the piano player may be reduced or eliminated by use of a set of multiple bridle strap and bridle wire combinations, each bridle strap and bridle wire combination connecting a piano hammer to a corresponding piano wippen assembly, wherein the bridle strap and bridle wire combinations are mounted and/or adjusted to maintain the hammer assemblies and corresponding wippen assemblies together in gap-minimizing motion when an associated piano key is played. For example, in one implementation, the tensioned bridle strap is mounted in a manner such that the span (i.e., effective length between attachments at opposite ends) of the tensioned bridle strap is approximately constant between initial position and final position, and also during transition between initial position and final position.

The effectiveness and extent of the improvement in "lost motion" in different instruments, or even in the same instrument, can be expected to vary, e.g., as a result of the skill, experience and habits of the player, the playing conditions, the environment, the level maintenance of the piano and its parts, etc.

The details of one or more implementations of the disclosure are set forth in the accompanying drawings and the description below. Other features, objects, and advantages of the disclosure will be apparent from the description and drawings, and from the claims.

DESCRIPTION OF DRAWINGS

FIG. 4A is a side view of the conventional (prior art) piano action of FIG. 2 in a return from played position, while FIG. 4B is a similar, somewhat enlarged, side view of the conventional (prior art) piano action of FIG. 4A showing a gap between the jack and the butt.

FIG. 5A is a side view of the conventional (prior art) piano action of FIG. 2 with the soft pedal depressed, while FIG. 5B is a similar, somewhat enlarged, side view of the conventional (prior art) piano action of FIG. 5A, showing a gap between the jack and butt.

FIG. 15A is a side view of the soft piano action of FIG. 14 with the soft pedal depressed, while FIG. 15B is a similar, somewhat enlarged, side view of the piano action of FIG. 15A, showing a gap between the wippen assembly and the capstan.

Like reference symbols in the various drawings indicate like elements.

DETAILED DESCRIPTION

Figure 1:
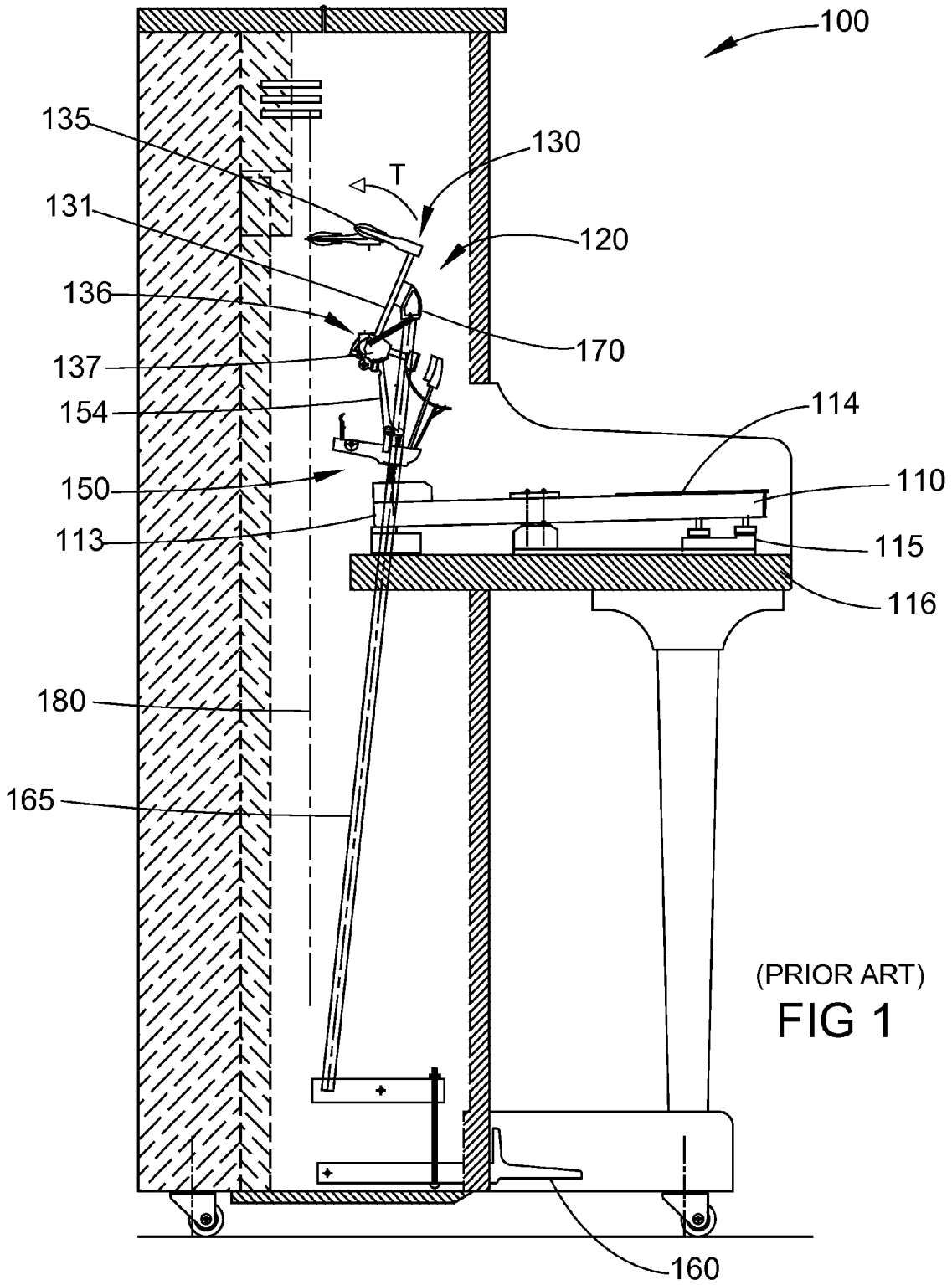
(PRIOR ART) FIG 1
FIG. 1 is a side section view of a conventional (prior art) upright piano with a soft pedal system.

Referring to FIG. 1, a conventional upright or vertical piano 100 includes a series (or set) of piano keys 110 and corresponding piano actions 120 linked to rear segments 113 of the piano keys 110, which rest on a keyframe 115 attached to a keybed 116. Each piano action 120 is actuated by depressing the exposed playing surface 114 of a corresponding key 110. A series (or set) of (piano) hammer assemblies 130 includes rotatable piano hammers 135, each defining a forward throw direction, T, which are driven by corresponding wippen assemblies 150, and transmit forces applied upon the playing surfaces 114 of the corresponding keys 110. Each piano hammer 135 is aligned to strike a corresponding piano string or group of strings 180 upon being thrown. For example, the hammer 135 may strike between one and three strings 180 to produce the desired tone of the corresponding depressed key 110.

Figure 2:
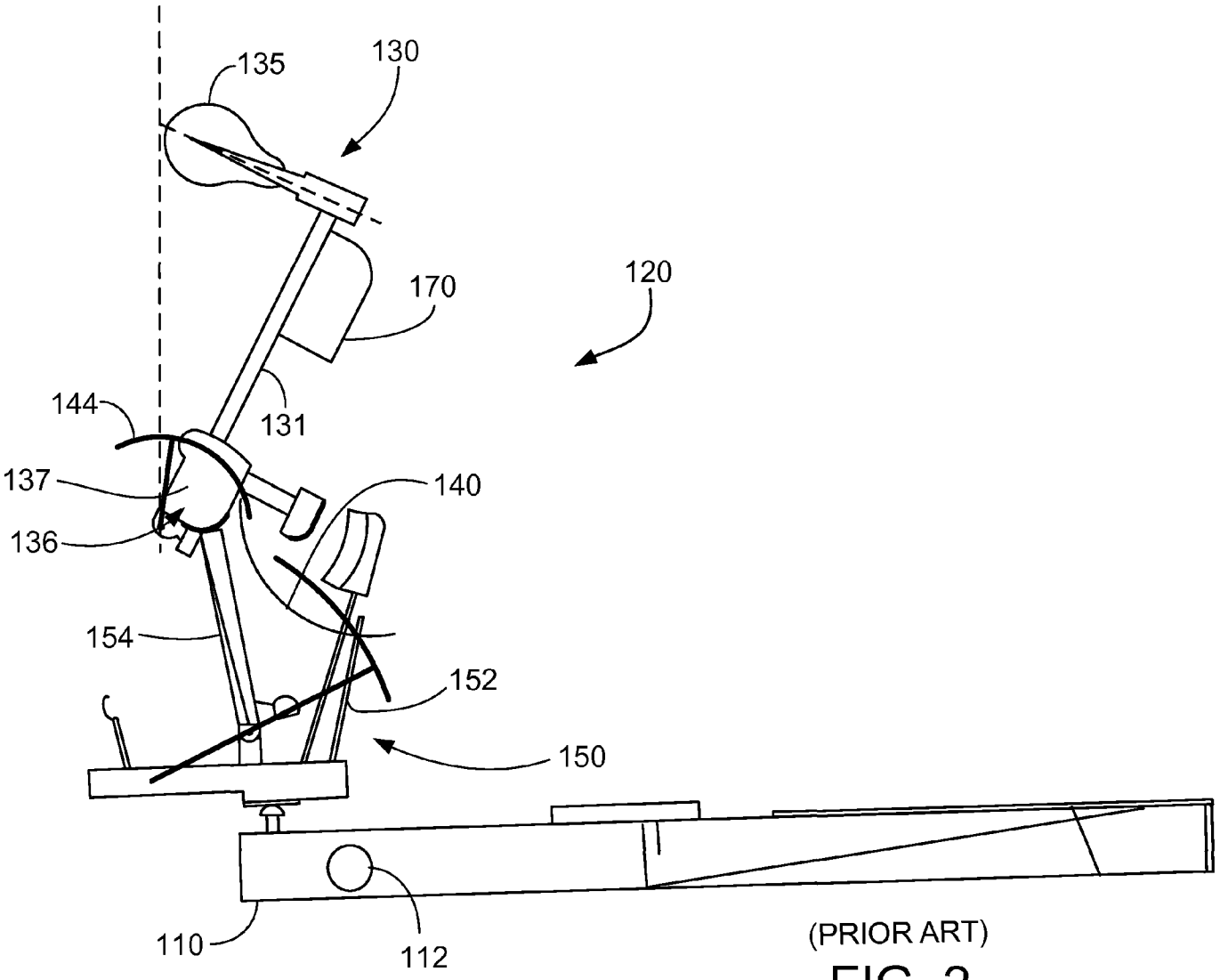
(PRIOR ART) FIG. 2
FIG. 2 is a side view of a piano action of conventional (prior art) design in an unplayed position.
Figure 3:
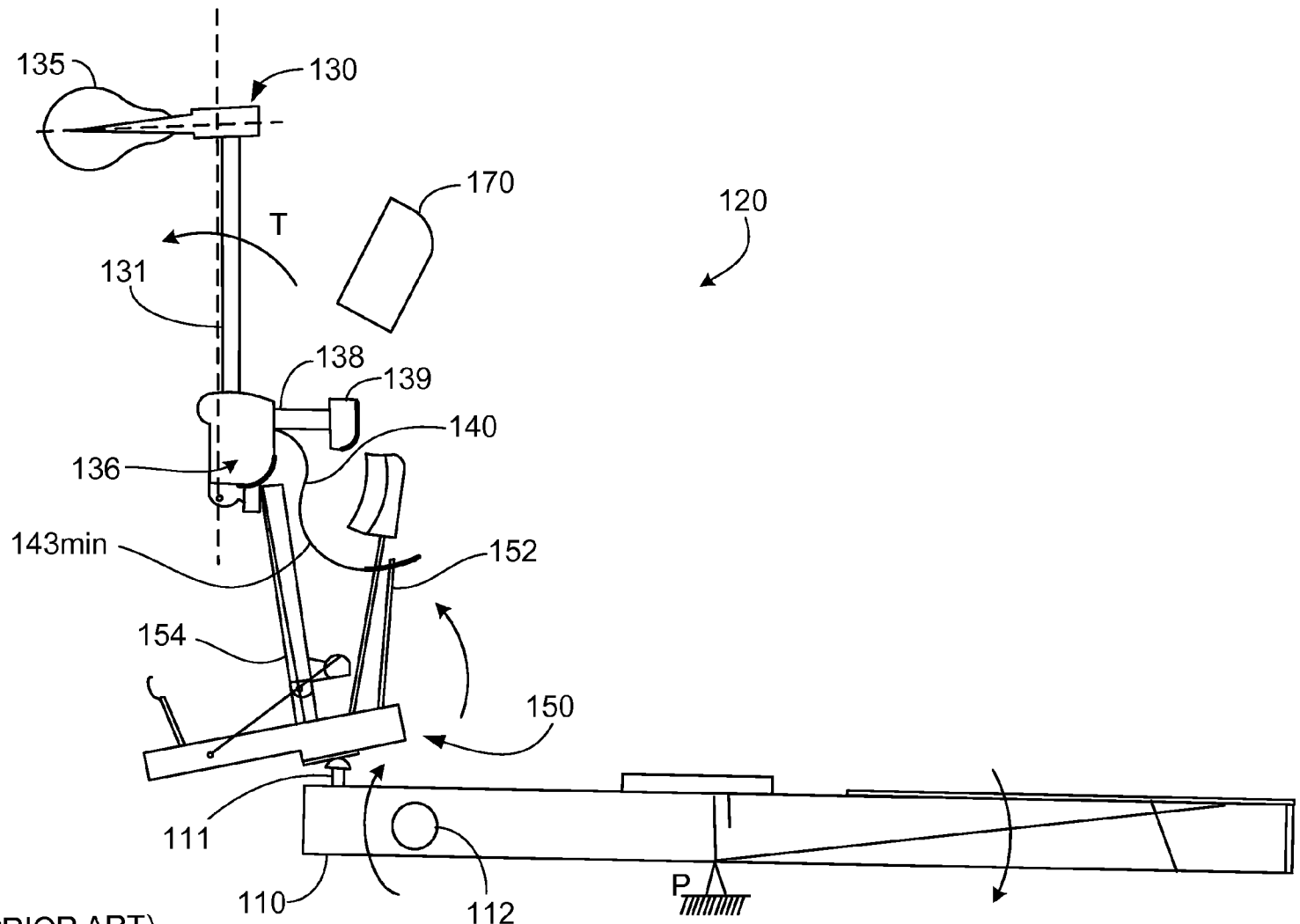
(PRIOR ART) FIG. 3
FIG. 3 is a side view of the conventional (prior art) piano action of FIG. 2 in a just-played position.

Referring to FIGS. 1 to 3, each hammer assembly 130 includes a hammer 135 mounted at an upper end of a hammer shank 131, with the lower end of the hammer shank mounted to a butt assembly 136. In the figures, the butt assembly 136 includes a butt 137, a dowel 138 and a catcher 139. Depressing or actuating piano key 110 causes a jack 154 of the associated wippen assembly 150 to push the butt assembly 136 of the hammer 135. When the jack 154 pushes the butt assembly 136, the butt assembly 136 and the hammer shank 131 are rotated in a forward throw direction, T, toward the piano string or strings 180 associated with the piano hammer 135. The piano hammer 135 strikes the piano string(s) 180, indirectly producing an acoustic sound. When the keys 110 are in a rest position, as shown in FIG. 2 (e.g., when a player is not pressing the keys 110), the hammers 135 remain in home positions, resting on a soft pedal or hammer rest rail 170 and/or the jack 154.

A thin, flexible tether, termed "bridle strap" 140, links the corresponding hammer and wippen assemblies 130, 150 and restricts these assemblies from rotating apart. In the conventional implementation, shown, e.g., in FIG. 2, one end of the bridle strap 140 is attached, e.g., permanently attached, to the hammer assembly 130 at the butt assembly 136. In other implementations (not shown in the figures), the bridle strap 140 is connected to the butt assembly 136 at the junction of the dowel 138 and catcher 139. During normal use, conventional bridle straps 140 remain slack and do not lift the wippen assemblies 150.

Referring to FIG. 2, when the key 110 is unplayed, the bridle strap 140 is typically curved and slack as it joins the hammer and wippen assemblies 130, 150, and it has an indeterminate span (or distance between ends). Upon key depression, as the key 110 pivots during play, the distance between the two terminations becomes smaller and the bridle strap 140 becomes relatively more relaxed (slack) to a minimum separation distance as the key is depressed, i.e., a bridle strap span smaller than the unplayed span.

FIG. 3 depicts the moment when key 110 has reached nearly full depression. The key 110 has been pivoted about its central pivot point (P), lifting the wippen assembly 150. This movement, in turn, has rotated the hammer assembly 130 toward the piano string 180 located to the left of the hammer assembly 130 (not shown). The flexible strap 140 is now noticeably more relaxed, i.e., the bridle strap span has decreased considerably from the initial span shown in FIG. 2.

Figures 4A, 4B:
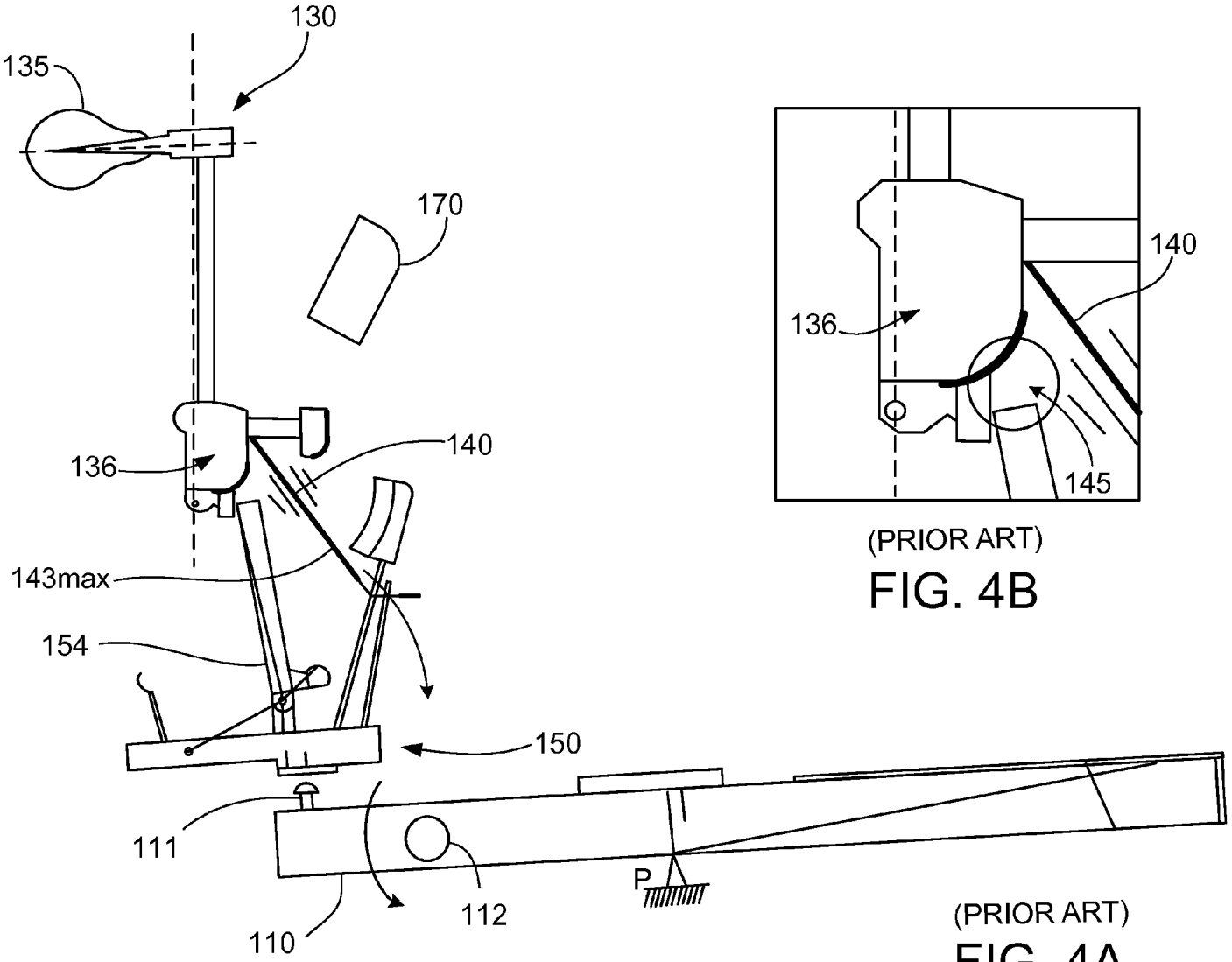
(PRIOR ART) FIG. 4B
(PRIOR ART) FIG. 4A

As shown in FIGS. 4A and 4B, having played the note and caused the piano hammer 135 to strike the appropriate piano string(s) 180, the musician releases the key 110. Key weights 112 associated with, e.g., embedded in, the rear segment 113 of the key cause the key 110 to immediately pivot, returning to its initial, unplayed position. As the key 110 is no longer supporting the piano action 120, the wippen assembly 150 falls downward, while the hammer assembly 130 lags behind, in part due to its center of gravity being nearly vertical above its center of rotation. Up to this point during a keystroke, the bridle strap 140 has served no function in the piano action. Only when the falling wippen assembly 150 tensions the bridle strap 140, which is at or near its maximum span, does the bridle strap activate and pull the hammer assembly 130 backward toward its rest position.

As shown most clearly in FIG. 4B, during this release of the piano key, a temporary gap 145 opens between the jack 154 of the wippen assembly 150 and the butt assembly 136 of the hammer assembly 130 due to the time lag between the return motions of the two assemblies (i.e., the wippen assembly 150 and the hammer assembly 130). The gap 145 causes an unwanted touch sensation, known as "lost motion", at the beginning of the next keystroke if the key is played again before the gap 145 closes. If a second keystroke is initiated at this point, i.e., during key release, a clear sense of lost motion can be detected as the new keystroke must cause the wippen assembly 150 to traverse the gap 145 before contacting the hammer assembly 130. This temporary change in the feel of the piano action is near universally considered to be a negative characteristic specific to upright or vertical pianos.

Lost motion also occurs when a soft pedal is depressed. Referring again to FIG. 1, when a soft pedal 160 of an upright or vertical piano 100 is depressed, an attached linkage or wire 165 actuates the hammer rest rail 170 to pivot all eighty-eight hammer assemblies 130 in a typical conventional (prior art) piano 100 upward and closer to the strings 180. This reduction in hammer travel distance creates a sense of lower, "softer" tonal volume in the piano 100.

Figures 5A, 5B:
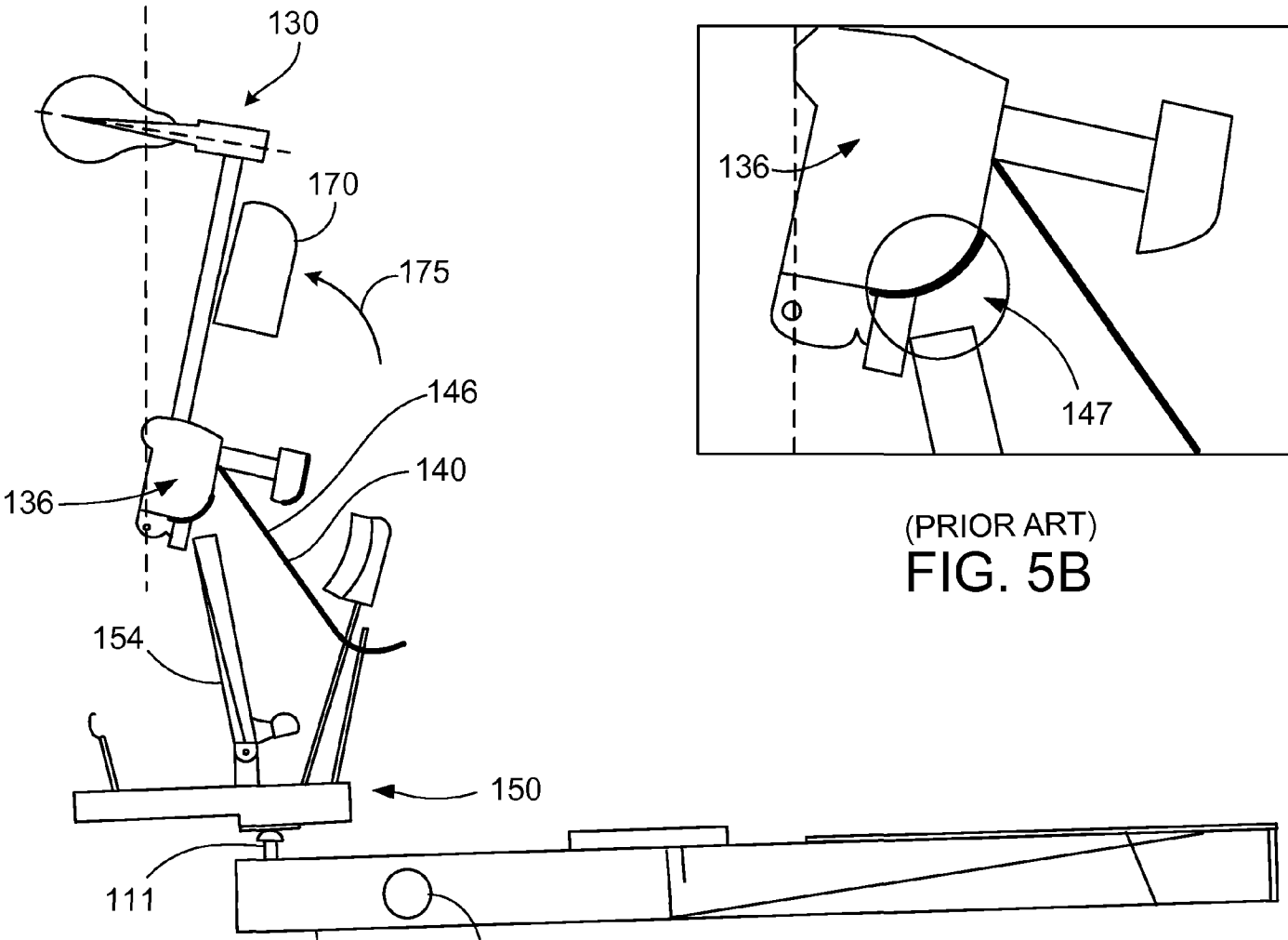
(PRIOR ART) FIG. 5B
(PRIOR ART) FIG. 5A

As shown in FIG. 5A, the motion of hammer rest rail 170 in the direction of resting rail motion (arrow 175) moves all of the hammer assemblies 130 upward and toward the piano strings 180. At full soft pedal 160 depression, the bridle strap 140 approaches a state of tension having a soft pedal span 146 (note its straightened attitude); however, the bridle strap 140 traditionally does not exert any lifting force on the lower wippen assembly 150. The soft pedal position of the hammer assemblies 130, in this lifted position, results in another occurrence of lost motion due to a gap 147 (FIG. 5B), produced between the jack 154 and the butt assembly 136. The gap 147, due to the rotation of the hammer assemblies 130, is produced uniformly across the keyboard of vertical piano 100 when the soft pedal 160 is depressed. When the soft pedal 160 is released, hammer assemblies 130 rotate back to their original positions, restoring their longer travel distance and eliminating the lost motion gap 147. As with the lost motion produced through rapidly repeated keystrokes in normal, non-soft pedal mode, the lost motion due to depression of soft pedal 160 has always been viewed as an undesirable but necessary compromise in the cost-limited upright or vertical piano action design.

Figure 6A:
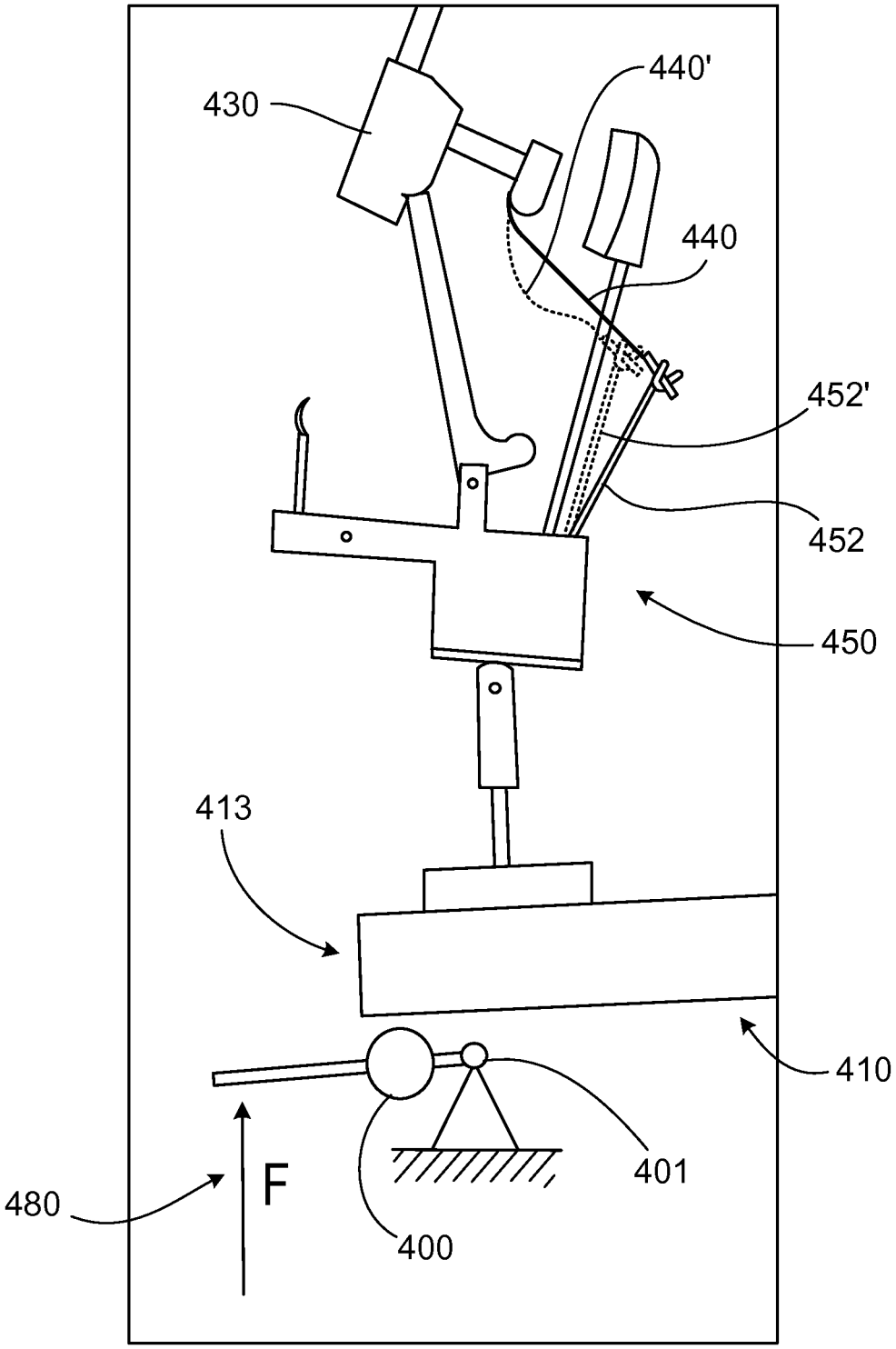
FIG. 6A is a side view, partially in section of a first configuration of an extended soft pedal piano action of this disclosure including a rigid lift rail.
Figures 15A, 15B:
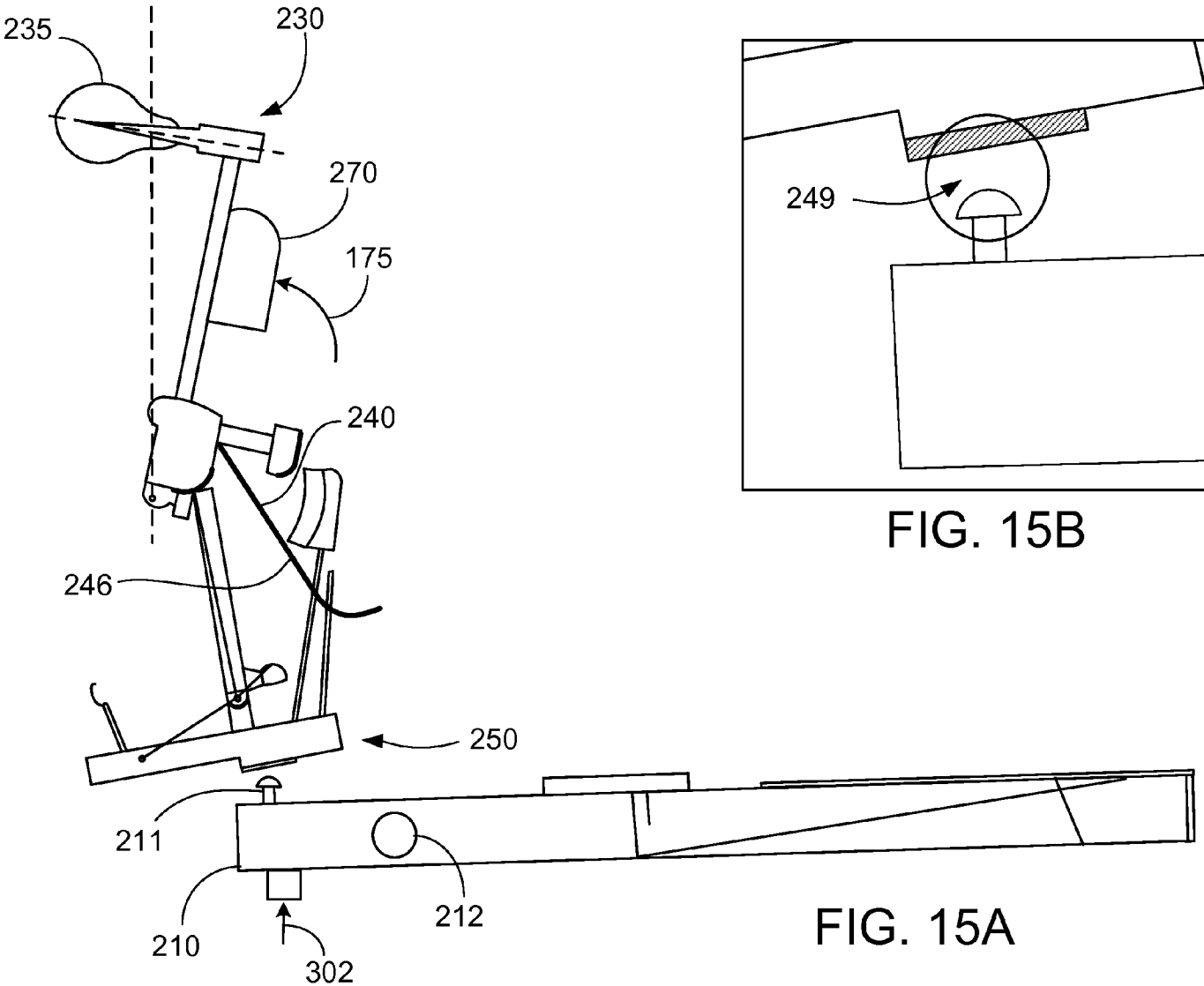

Referring to FIG. 6A, the piano key action arrangement of the current disclosure reduces the unwanted feel of lost motion by closing, or even eliminating, the gaps 145 and 147 between the hammer and wippen assemblies 430, 450, and undesirable gap 249 between the capstans and wippen assemblies can also result in the unwanted feeling of lost motion when the soft pedal is depressed (see FIGS. 15A and 15B). To compensate for the gap 249, a key lifting assembly including a rigid key lift rail 400 is positioned beneath the key rear segments 413 and lifts the keys 410. The rigid key lift rail 400 rotates around a fulcrum or pivot point 401. The lift rail 400 supports the keys 410 in a manner to maintain the keys at least in close proximity to, or, more preferably, in contact with, the wippen assembly 450. This arrangement results in significant reduction, or elimination, of the gaps 249 and 147 that otherwise result in lost motion of the piano action 420 during playing of the piano.

Figure 6B:
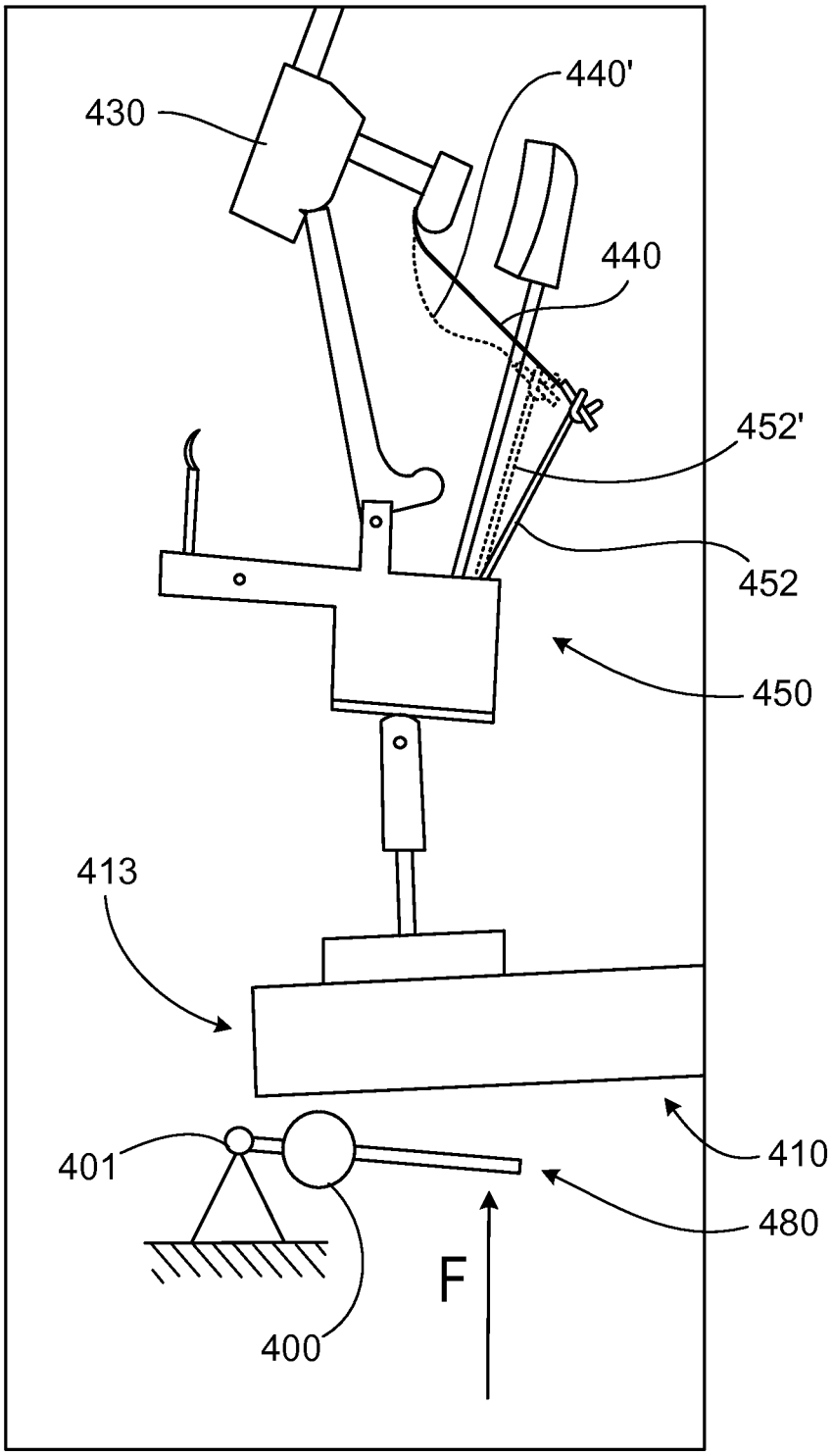
FIG. 6B is a side view, partially in section of a second configuration of an extended soft pedal piano action of this disclosure including a rigid lift rail.

In preferred implementations, at least three, e.g., four, five or more, co-linear pivot points 401 are located along the length of the piano keybed and act to support the rigid key lift rail 400 that contacts all eighty-eight keys 410. The rigid key lift rail 400 is lifted or pivoted by a rigid linkage system 480 represented by force, F, in the drawing. As shown in FIGS. 6A and 6B, force, F, can be applied either behind or in front of the key rears 413, as long as the rigid key lift rail 400 rotates to contact the key rears 413.

By way of example only, three collinear pivot points 401 distribute the lifting force, F, along the keybed, reducing flexure and ensuring that the rigid key lift rail 400 lifts all keys 410 by substantially the same distance. As the rigid lift key rail 400 is desirably inflexible, the rigid key lift rail 400 can lift all key rear segments 413 as well as the wippen assemblies 450, uniformly. This improvement may be achieved, e.g., by a reduction in flexure of the rigid rail 400, i.e. by employing multiple (in this implementation, e.g., three or more, e.g., five) pivot points 401, or by employing a rail 400 relatively greater stiffness or rigidity, and/or by reducing or eliminating flexibility resulting from use of spring assemblies 310, as in other implementations discussed below. Flexibility in the spring arrangement increases the difficulty of calibrating multiple, e.g. more than two, springs evenly, thus, for reasons of practicality, restriction of the support to two springs. The springs can also experience variations of the spring lifting force over time. In contrast, the rigid key lift rail 400 of this disclosure is effectively inflexible and provides a constant, uniform lifting of the lift rail that is predictable spatially and over time, e.g. with typical variations in lifting force over time that would be undetectable to even an expert user of the piano 100, e.g., lifting distances of less than the thickness of a thin sheet of paper.

Figure 9:
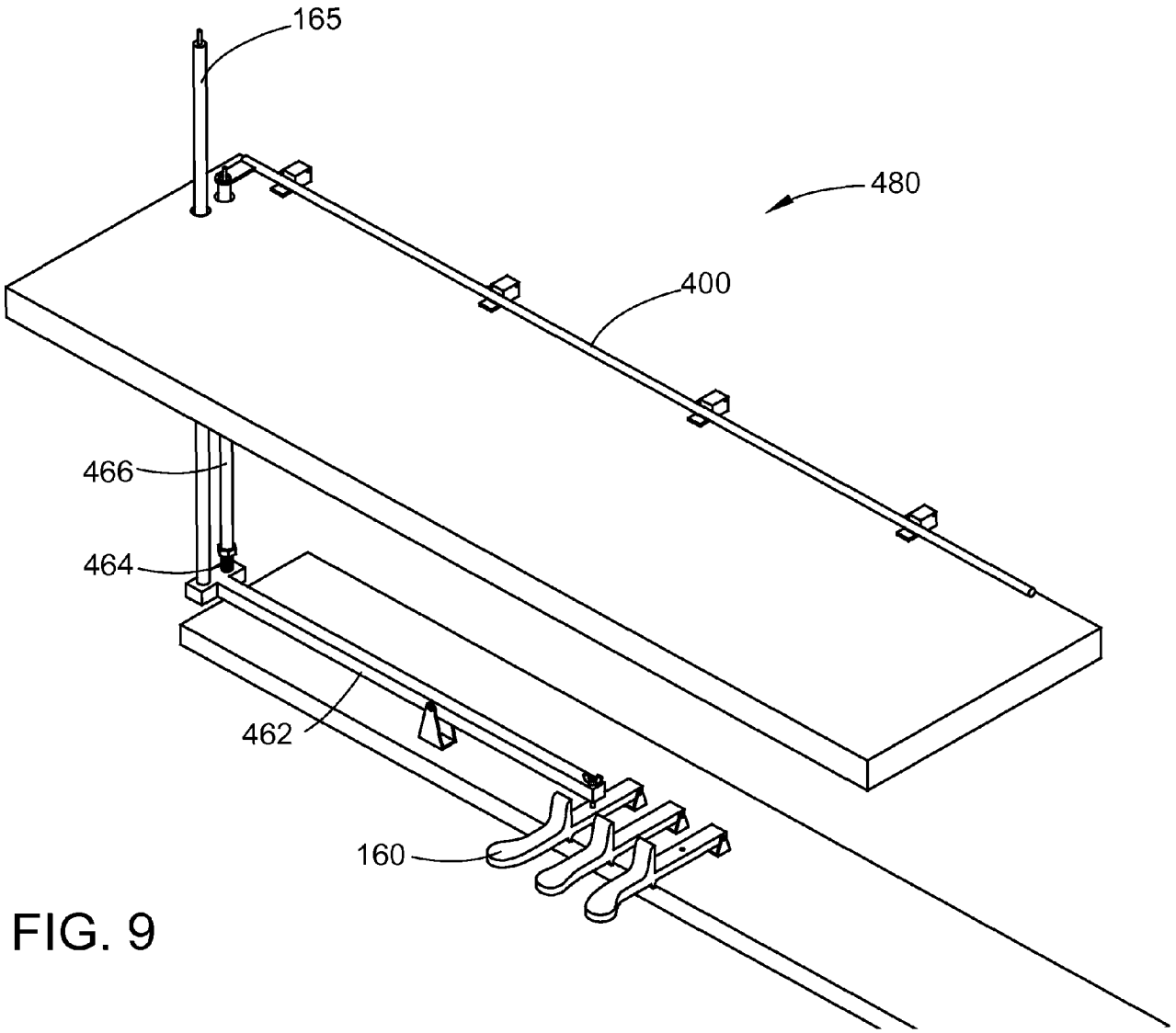
FIG. 9 is a front view of bottom portion of an upright piano including a rigid linkage system lifting an embodiment of the rigid lift rail of FIG. 6A.

The rigid key lift rail 400 is lifted in the direction shown by the arrow, F, (FIGS. 6A and 6B) when the soft pedal 160 is depressed (shown in FIGS. 1 and 9). Depressing the soft pedal 160 lifts the wippen assemblies 450, eliminating gap 249 between the key rear segments 413 and the wippen assemblies 450 (shown in FIGS. 15A and 15B), and closing gap 145 of FIG. 4B between the wippen assemblies 450 and the hammer assemblies 430. In some implementations, contact between the rigid key lift rail 400 and the key rear segments 413 can be observed to cause the keys 410 to pivot, i.e., cause the front of the keys 410 to move downwards to some extent, e.g., 3-5 mm (or up to 2-7 mm in extreme adjustments) out of a total keystroke of about 10 mm measured at the front edge of the key, in response to the key rear segments 413 pivoting slightly upwards, depending on the magnitude of force, F.

Figure 7:
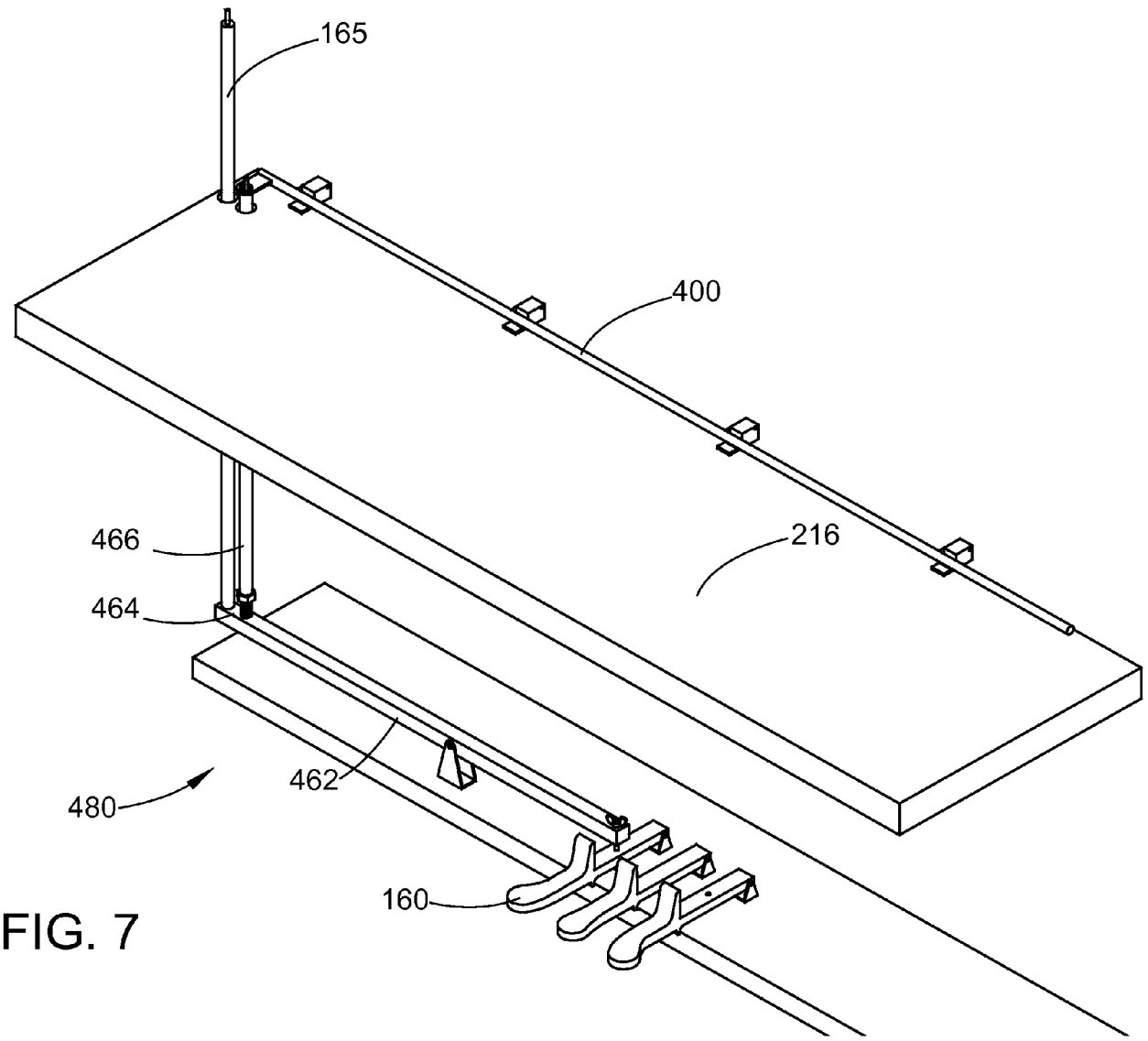
FIG. 7 is a front view of bottom portion of an upright piano including a rigid linkage system lifting an embodiment of the rigid lift rail of FIG. 6A.

As shown in FIG. 7, the linkage system 480 communicates the actuating motion (of the player's foot) applied upon the soft pedal 160 to the rigid key lift rail 400. Like the traditional piano 100 shown in FIG. 1, the piano configuration of FIG. 7 includes a linkage or hammer rest rail rod 165 that actuates the hammer rest rail 170 to pivot all eighty-eight hammer assemblies 430 upwards, closer to the strings 180. In the implementation shown in the drawings, the linkage system 480 also includes an additional piano key lift rail rod 466, positioned vertically inside the lower half of the piano case. In the implementation shown in FIG. 7, the bottom end of the piano key lift rail rod 466 rests on a soft pedal trap lever 462, while the top end pushes up on the rigid piano key lift rail 400. When the soft pedal 160 is actuated, force is transmitted along the soft pedal trap lever 462 to both the linkage or hammer rest rail rod 165 (which lifts the hammer rest rail 170 to pivot the hammer assemblies 430) and the piano key lift rail rod 466, which raises the rigid piano key lift rail 400, and with it, the piano key rear segments 413 and the wippen assemblies 450.

Figure 10:
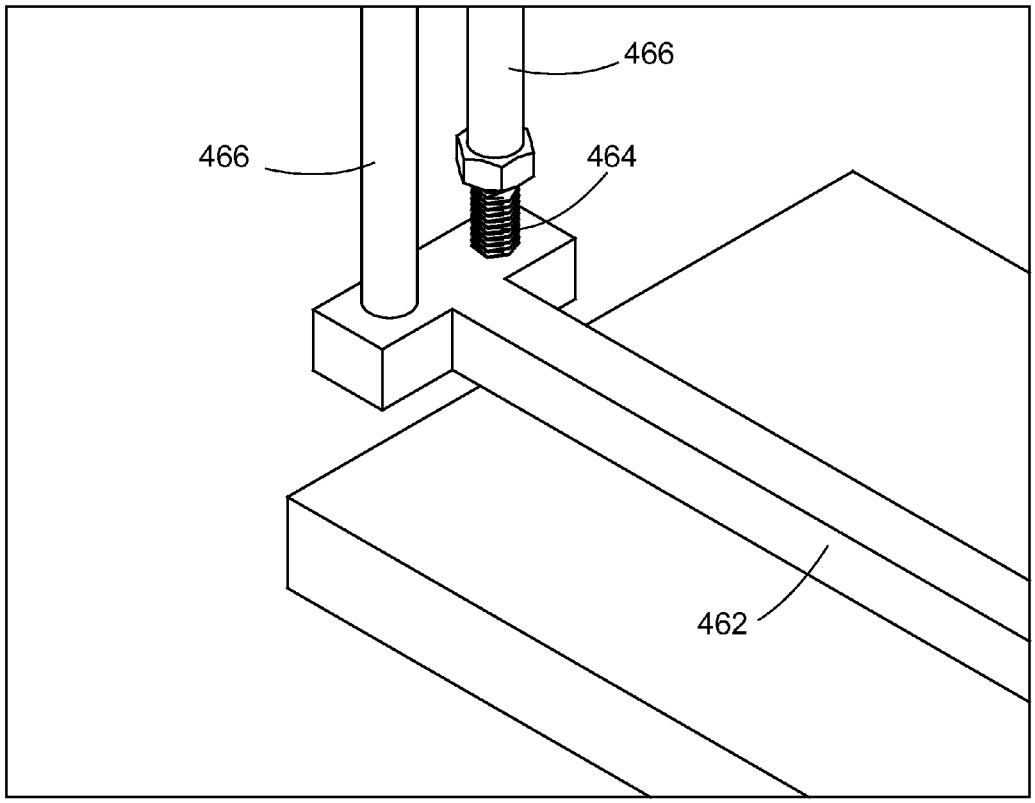
FIG. 10 is a close up view of a portion of the rigid linkage system of FIG. 9.

To account for two separate motions being actuated by depression of the soft pedal 160, lift rod 466 can be adjusted for length via an in-line length adjuster 464. The length adjuster 464 regulates the lifting height of the two rods 165, 466 independently of each other. In the implementation shown in FIG. 8, the length adjuster 464 is consists of a co-axial adjustment screw with a locking mechanism such as a locknut or friction threads, as is known in the art, and the linkage 165 and lift rod 466 are located longitudinally displaced (i.e., in succession) along the soft pedal trap lever 462. In another implementation, shown in FIGS. 9 and 10, the two rods 165, 466 are located at the same longitudinal distance from the soft pedal 160, and a second embodiment of the length adjuster 464 still permits the length of lift rod 466 to be adjusted independently of linkage 165. In both implementations, the length adjuster 464 modifies the maximum lift height of the key lift rail, and can be adjusted after adjusting a nut (e.g., a wingnut) traditionally found on pianos for adjustment of the maximum lift height of the hammer rest rod.

The linkage system 480 described herein includes a rigid lift rod 466. However, other implementations contemplated; for example, a cable and pulley system may alternatively be employed for lifting the rigid key lift rail 400, and it may also be adjusted to work in synchronization with the soft pedal motion of a traditional piano 100. For example, the hammer rest rail 270 may lift the rigid key lift rail 400 via a cable, or other link. When the soft pedal 160 is depressed, a traditional lift rod 165 lifts the hammer rest rail 270, which pulls up the key lift rail 400 via the cable or link. Alternatively, a bicycle-type cable-in-a-housing may be provided to raise the key lift rail, either with or without a pulley. In other implementations, an electromagnetic actuator, such as is known in the art, may alternatively be employed for lifting the rigid key lift rail 400, and it may also be adjusted to work in synchronization with the soft pedal motion of a traditional piano 100.

The rigid key lift rail 400 lifts the wippen assemblies 450 as a group and removes lost motion during depression of soft pedal 160. Precision configuration adjustment of each bridle wire 452 and bridle strap 440 combination, e.g. as described for prior implementations, is significantly less critical, and it is replaced by the global lifting of keys 410 and wippen assemblies 450 by the rigid key lift rail 400.

Referring again to FIG. 6A, the traditional slack bridle strap 440' can be repositioned to a state of higher tension 440 by shortening and/or bending the traditional bridle wire 452' to the position of use, i.e., bridle wire 452. As described with respect to other implementations, a tightened bridle wire 452 and bridle strap 440 function to reduce dynamic lost motion (i.e., eliminate gap 145). The rigid key lift rail 400 removes dynamic lost motion (i.e., eliminating gap 145), and also reliably removes static lost motion (i.e., gap 147) that occurs only in soft mode.

In the present implementation, adjustment of the bridle wire/strap 452/440 can be simple and durable, without requiring precision or repeated adjustment. As a result, the tensioning function can be achieved without precision adjustment. For example, the optimal height of bridle wire 452 (and also its angle and location) can be arranged during manufacture, instead of (or in addition to, if desired) during hand-regulation of the bridle wires 452 after the piano has been assembled, resulting in the advantages described herein. Tensioning of the bridle wires 452 to specification can be performed during the standard regulation operation, with no additional regulating labor, or it may electively be foregone completely, relying instead entirely upon the soft pedal system of this disclosure.

The configurations disclosed herein thus allow an upright piano to capture the performance benefits of reduced, or eliminated, lost motion during normal playing modes, while no longer relying on the bridle strap to precisely lift the wippen during soft pedal mode performance.

Figure 11:
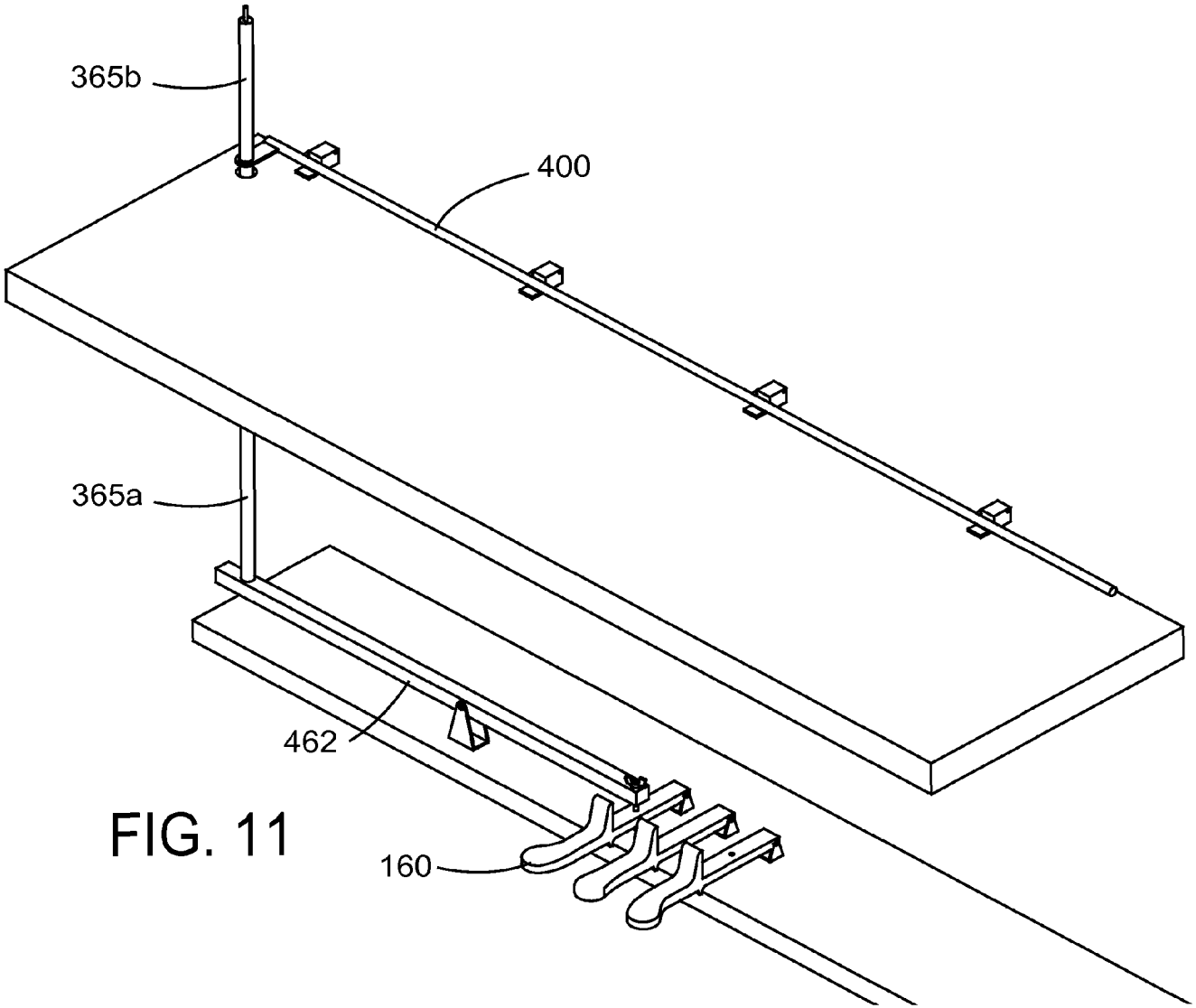
FIG. 11 is a front view of bottom portion of an upright piano including a rigid linkage system lifting an embodiment of the rigid lift rail of FIG. 6A.
Figure 12:
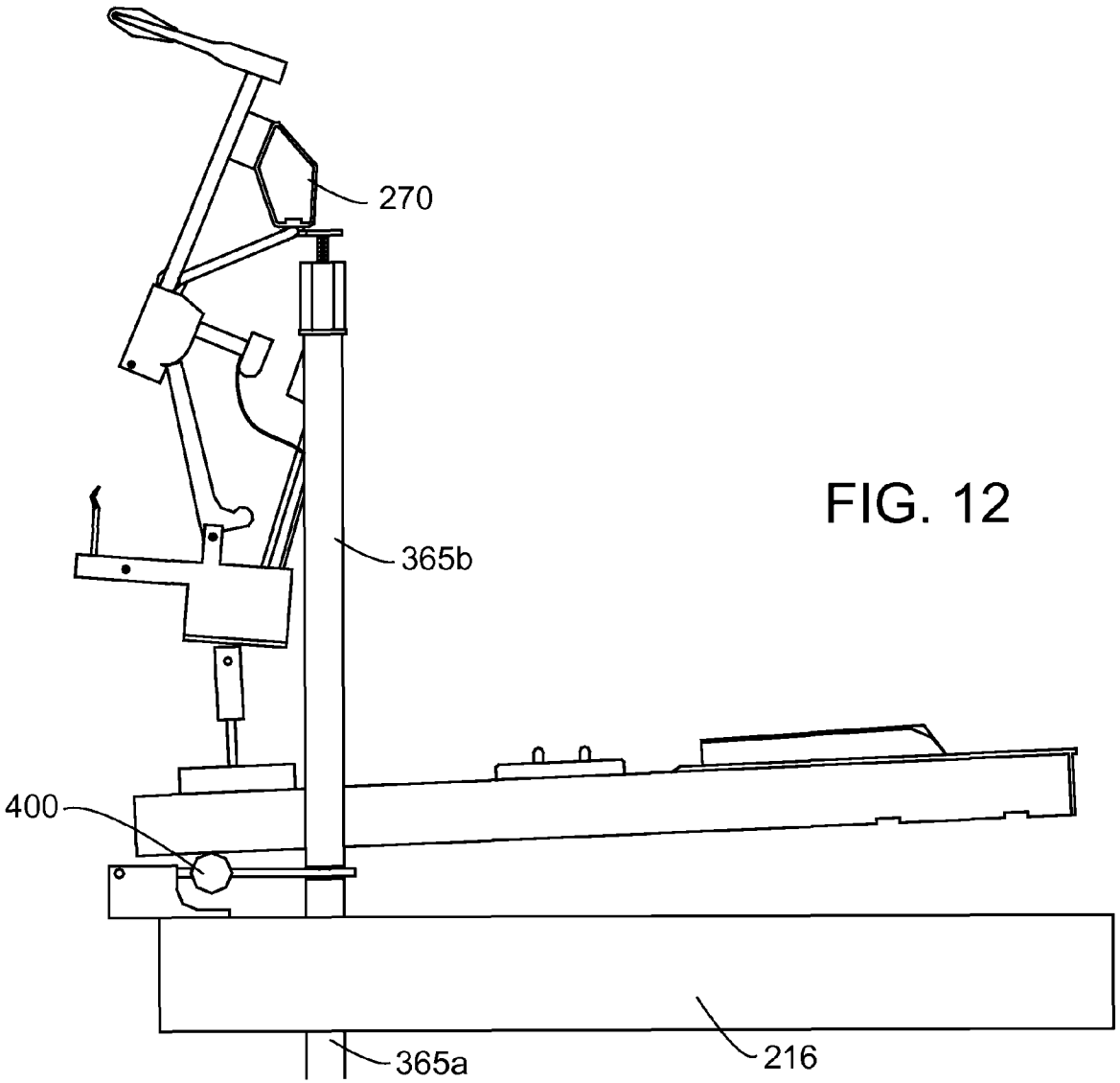
FIG. 12 is a close up view of a portion of the rigid linkage system of FIG. 11.

Referring to FIGS. 11 and 12, in another implementation of the soft pedal system, a single rod 365 is mounted upon the soft pedal trap lever 462. This single rod 365 is formed of two stacked rod segments 365*a*, 365*b*. The lower rod segment 365*a* lifts the rigid key lift rail 400 and simultaneously lifts the upper rod segment 365*b*, which in turn lifts the hammer rest rail 270. The rod 365 is configured such that upper rod segment 365*b* lifts only the hammer rest rail 270 while the lower rod segment 365*a* lifts both the upper rod segment 365*b* and the rigid key lift rail 400. The gap-closing motion described above is achieved by both stacked rod segments 365*a*, 365*b*. The length of upper rod segment 365*b* can be adjusted independently of the length of lower rod segment 365*a*. In this implementation, a length adjuster 464 modifies the maximum lift height of the hammer rest rail, and can be adjusted after adjusting a nut (e.g., a wingnut) traditionally found on pianos for adjustment of the maximum lift height of the key lift rail and hammer rest rail. Alternatively, with an in-line axial adjuster located at the rod-rail junction, the traditional nut (e.g., wingnut) can first be used to adjust the maximum lift height of the hammer rest rail and the key lift rail, after which fixed length rod 365 can be rotated for final adjustment of the maximum lift height of key lift rail.

Figure 13:
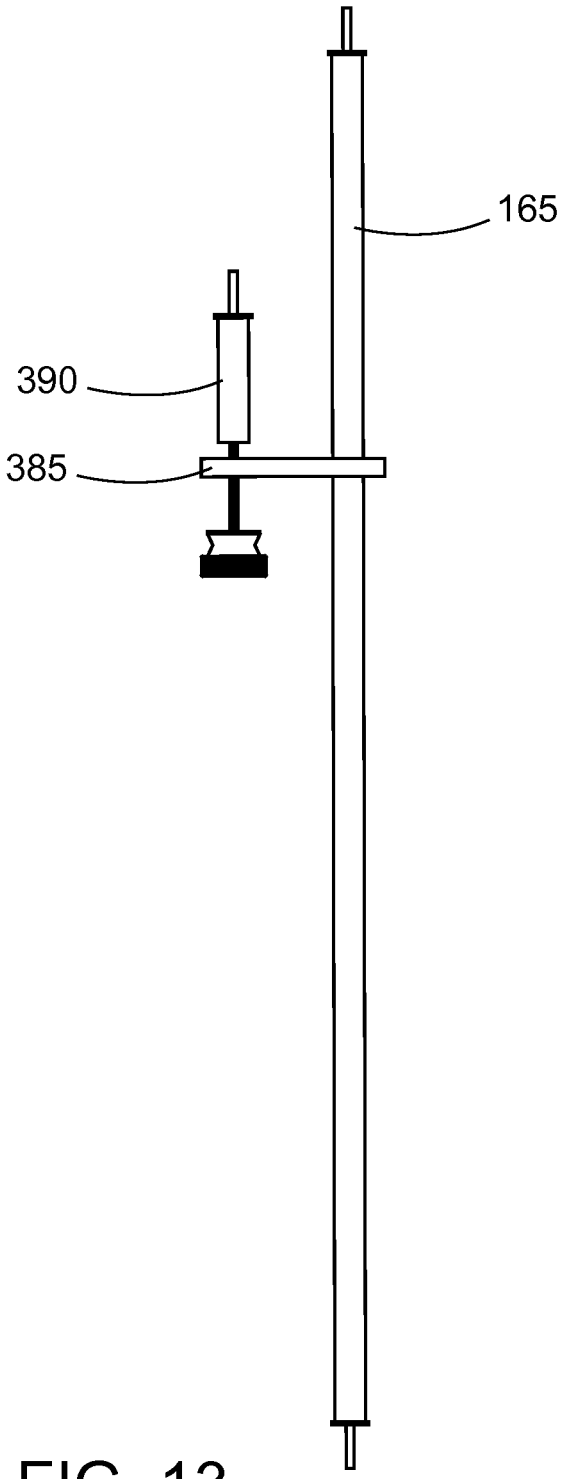
FIG. 13 is a portion of an embodiment of a rigid linkage system.

FIG. 13 shows a further implementation of this disclosure, in which a traditional soft pedal linkage 165 spans from the soft pedal trap lever 462 up to the hammer rest rail 270. An appendage 385 positioned approximately two-thirds up rod 165 pushes upward on a short rod or linkage 390, which in turn pushes up on the rigid key lift rail 400, resulting in the gap-closing motion discussed above.

Figure 14:
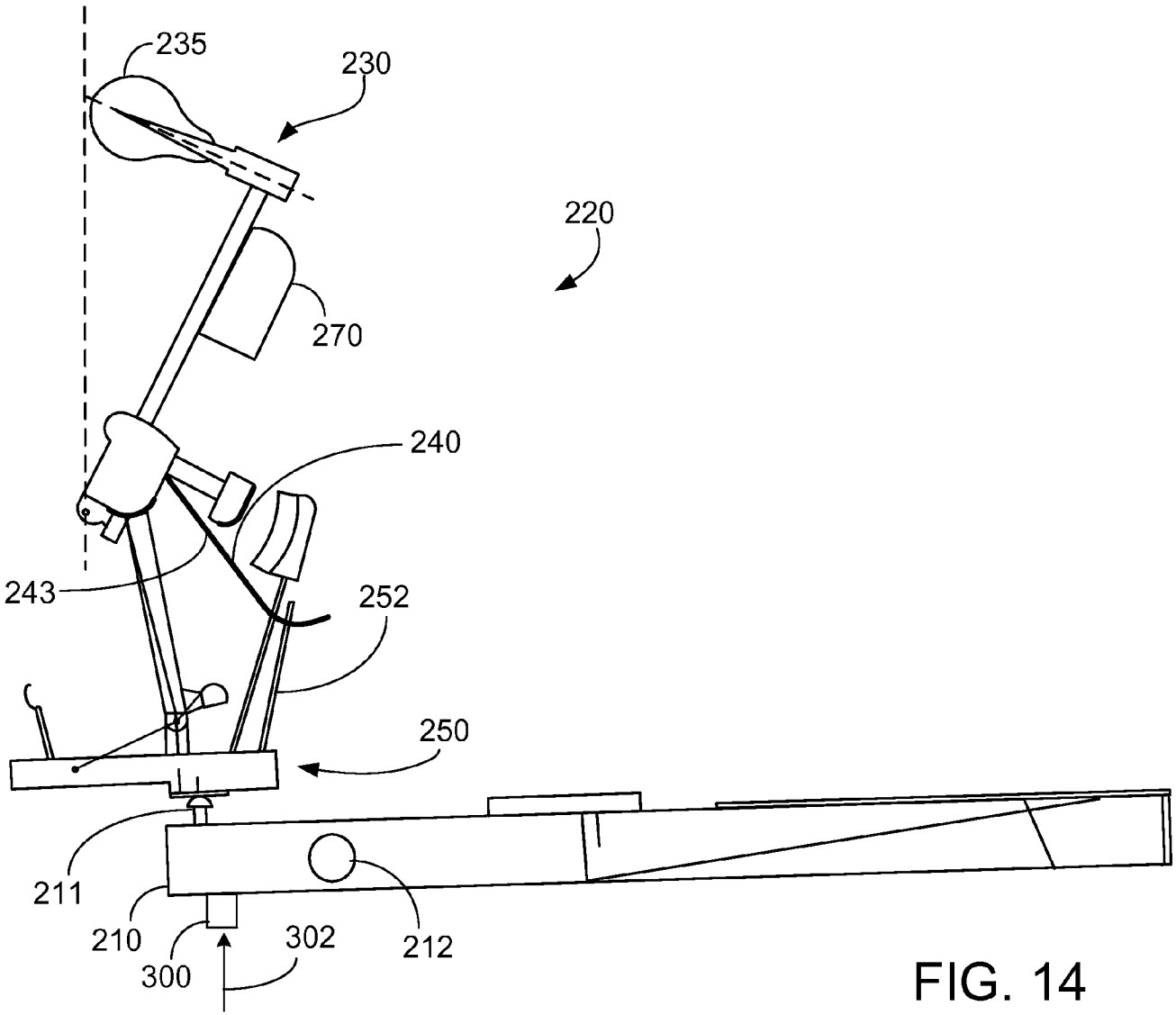
FIG. 14 is a side view, partially in section, of an extended soft pedal piano action of this disclosure including a rail, in an unplayed position

In another implementation of an upright piano, a piano action 220, shown, e.g., in FIG. 14 et seq., includes a relatively more tensioned bridle strap 240 and bridle wire 252 combination, i.e., a piano action 220 in which one or both of bridle strap 240 and bridle wire 252 are tensioned, or at least relatively more tensioned, than in conventional (prior art) upright or vertical pianos. In particular, the respective lengths of the bridle wire 252 and bridle strap 240 are chosen to maintain tensioning of the bridle strap 240 across the span between attachment of its respective ends to the bridle wire 252 and to the hammer assembly 230, with the span of the tensioned bridle strap being approximately constant between initial position and final position, and also during transition between initial position and final position. This permits the bridle strap 240, with minimal or no slack in rest position, to maintain a relatively constant tension through key depression and release. The gap 145, resulting in prior art pianos largely from a slack bridal strap, is largely eliminated, thereby greatly reducing or eliminating lost motion between the piano hammer and piano wippen assemblies 230, 250 during rapidly repeated keystrokes in normal, non-soft pedal mode.

The relatively more tensioned bridle strap 240 and bridle wire 252 combination also produces a striking addition to the function of soft pedal 260, reducing the unwanted feel of lost motion by reducing or eliminating the gap 147 (FIG. 5B) between the hammer and wippen assemblies 230, 250 when the soft pedal is depressed. Since the bridle strap 240 is now at least close to tension in rest position (as shown in FIG. 14), during the raising of the hammers 235 with the soft pedal 260, the hammer and wippen assemblies 230, 250 remain in gap-closing proximity to, or in engagement with, each other at all times.

Referring as well to FIG. 15A, with the relatively more tensioned bridle strap 240 and bridle wire 252 combination, depressing the soft pedal 260 rotates the hammer rest rail 270 and hammer assemblies 230, as in the traditional design (e.g., in the direction of motion 275). Now, however, the relatively more tensioned bridle strap 240 and bridle wire 252 combinations lift the wippen assemblies 250 in tandem with the hammer assemblies 230, removing all the weight of the piano action 220 from the keys 210. The bridle strap 240 remains close to or in tension throughout motion of the piano action 220 (i.e., span 246 remains relatively unchanged during movement of the action 220). Additionally, the soft pedal bridle strap span 246 is relatively unchanged from the bridle strap span 243 in normal mode (see FIG. 14).

Vertical or upright pianos, e.g. such as piano 100, are typically weighted in their rear segments 113 in order to achieve a desired level of touch resistance in the keys (in contrast to grand piano keys, which are typically weighted in the front segments). In the embodiment of the upright piano 200 of this disclosure, as shown in FIG. 15A, the keys 210 have key weights 212 in the rear segment 213. As a result, the vertical piano keys do not apply upward force against the hammer and wippen assemblies 230, 250, and so the presence of any lost motion, due either to use of the soft pedal 260 or to the playing of rapid, repeated keystrokes, is not mitigated by the keys. In other implementations, the keys 210 may not include weights 212, and thus may be unweighted in either the front or rear segments of the keys.

Referring to FIGS. 15A and 15B, an undesirable gap 249, between capstans 211 and wippen assemblies 250, can also result in the unwanted feeling of lost motion when the soft pedal 260 is depressed. To compensate for the gap 249 in the piano action 220, a key lifting assembly including a lightly sprung lift rail 300 is positioned beneath the key rear segment 213. This lift rail 300 is mounted for movement in a direction of lift rail action (arrow 302) between a first position, preferably touching the bottom surface of, but not lifting, all 88 keys, and a second position, in which the lift rail 300 pivots (or otherwise moves) to lift the key rear segments 213, causing them to follow the motion of the wippen assemblies 230, thereby eliminating lost motion. Since the keys 210 pivot very easily, only a light spring force is applied by the lift rail 300 of the present disclosure, which therefore does not intrude on the touch characteristics of the piano action 220.

Figure 15C:
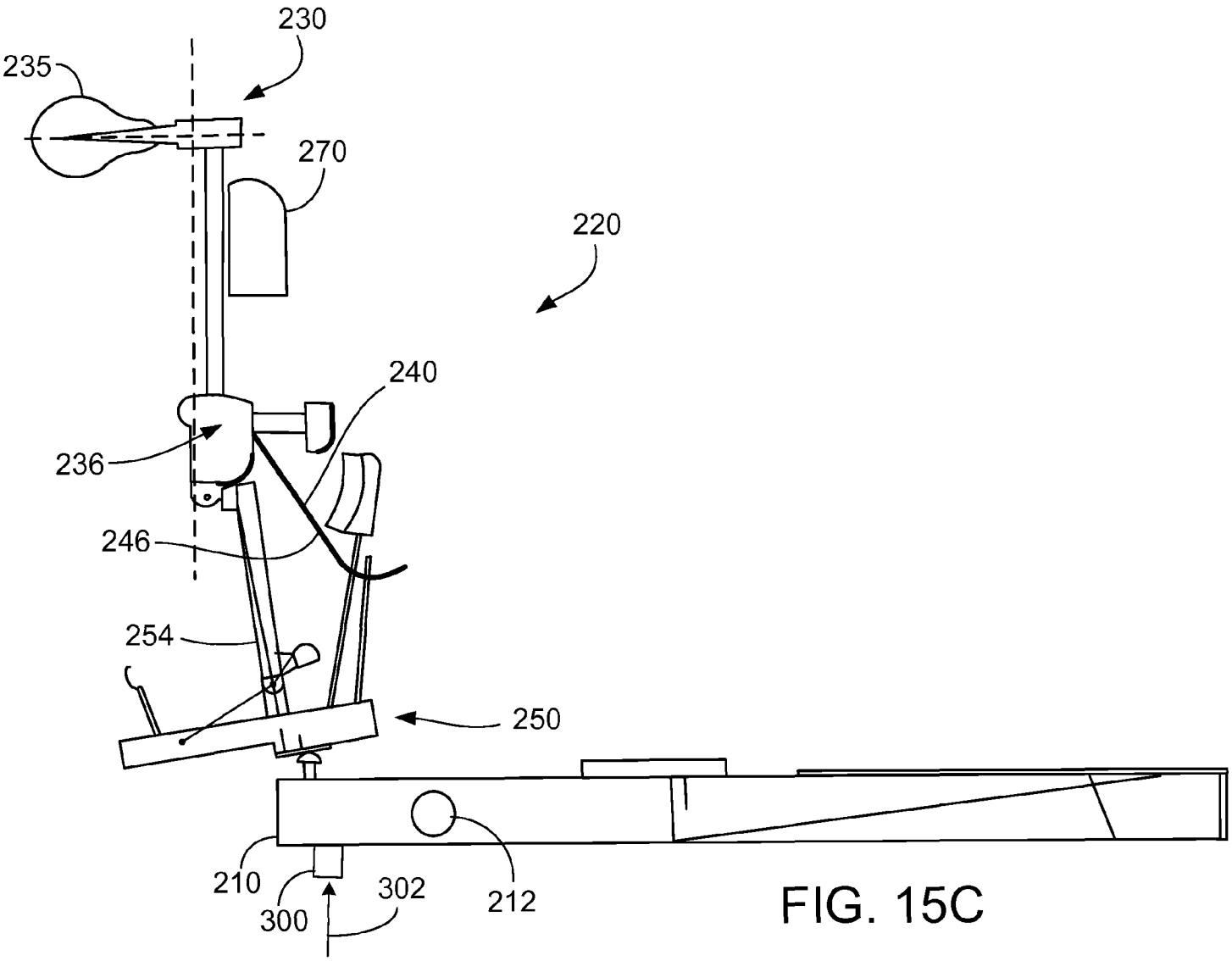
FIG. 15C is a side view of the soft pedal piano action of FIG. 14 with the lost motion-producing gaps closed.

Referring to FIG. 15C, the action 220 of the piano 200 of this disclosure is shown with the soft pedal 260 depressed and the lift rail 300 engaged. The lift rail 300 supports the keys 210 in a manner to maintain the keys in at least close proximity to, or in contact with, the wippen assembly 250. The combination of the lift rail 300 with the relatively tensioned bridle strap 240 and bridle wire 252 combination maintains contact between the keys 210 and the wippen assembly 250, and between the jack 254 and the butt assembly 236. During motion of the piano action 220, the span 246 of the bridle strap 240 and bridle wire combination remains generally constant, including at the start and end points of, and during, travel. This design results in significant reduction, or elimination, of the gaps 249 and 147 resulting in lost motion of the piano action 220 during playing of the piano.

Figure 16:
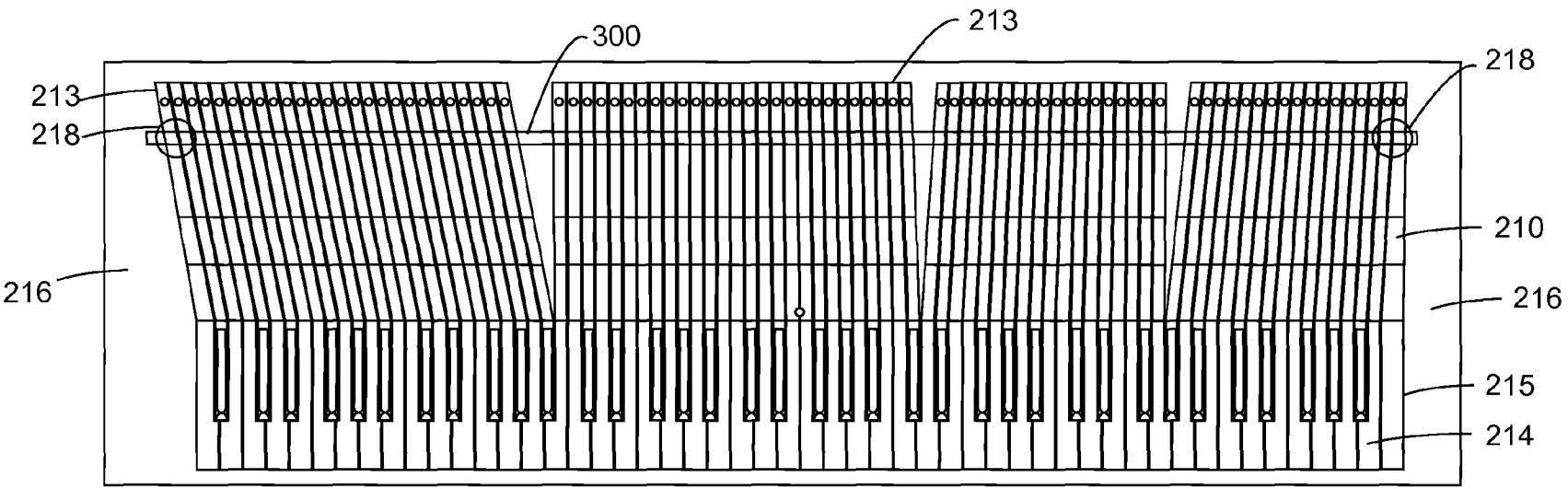
FIG. 16 is a top view of an upright piano including the extended soft pedal piano action of FIG. 14.

In FIG. 16, the key and keybed area of an upright piano 200 of this disclosure is shown in a top view, including keys 210 and the playing surfaces 214 of the keys. The keys 210 rest on a supporting keyframe 215, which is supported by a keybed 216. The lift rail 300 (shown in cross section in FIG. 15A) spans the eighty-eight keys 210 of the upright piano, beneath the rear segments 213 of the keys 210.

Two or more lift rail spring assemblies 310, which are also part of the key lifting assembly, are located at various selected positions beneath the keys along the length of the keyboard to provide force sufficient to lift the keys 210. For example, the lift rail spring assemblies 310 can be located near the first key and the last keys, such as at position(s) 218. Alternatively, the lift rail spring assemblies 310 can be located at other positions along the keys, such as at one quarter and at three quarters along the length of the keyboard, or at one third and two thirds along the length of the keyboard. There can also be more than two lift rail spring assemblies 310 arranged at various positions along the keyboard. Similarly, the embodiment as shown in FIG. 16 can have contact points as position(s) 218, or have three or more contact positions.

Figure 8:
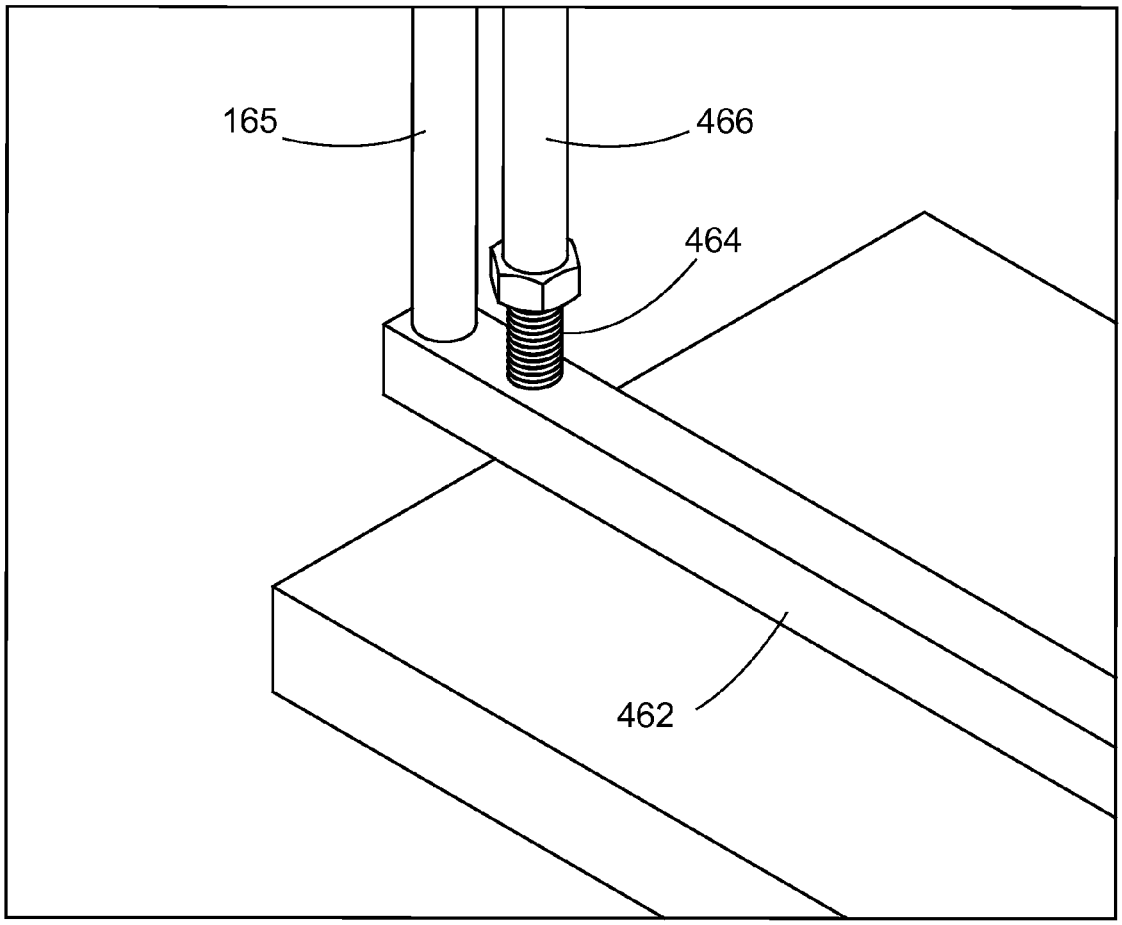
FIG. 8 is a close up view of a portion of the rigid linkage system of FIG. 7.
Figure 17:
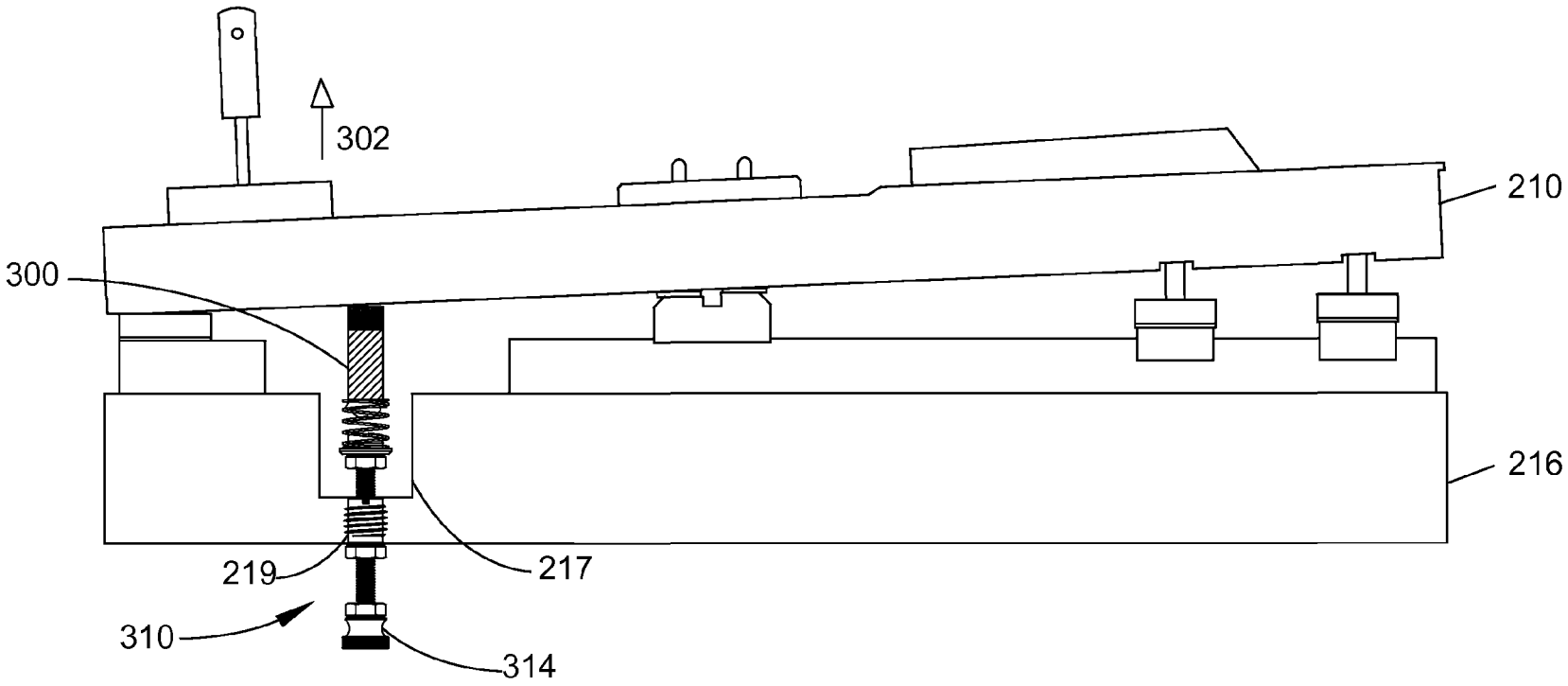
FIG. 17 is a side view, partially in section, of the extended soft pedal piano action of FIG. 14 including a lift rail spring assembly.

Referring to FIG. 17, in another implementation of the lift rail spring assembly of this disclosure, key 210 is shown in cross section above the rail spring assembly 310, in an unlifted position. The key 210 (and each of the keys 210) rests against the lift rail 300. Each lift rail spring assembly 310 is fastened (e.g., with screws countersunk into holes 217 provided in keybed 216) into position (e.g., position 218, as shown in FIG. 8). An adjustment member, e.g. a knob, 314 is provided for raising (and/or lowering) the set position of the lift rail 300, and therefore of the keys 210, upwards (and/or downwards), thereby increasing (and/or decreasing) the lift force applied by the rail spring assembly 310. Alternatively, adjustment member 314 can be, e.g., a thumb screw, an Allen bolt adjustable by wrench, a screw adjustable by a screwdriver, or other suitable rotatable threaded or otherwise adjustable member.

Figure 18:
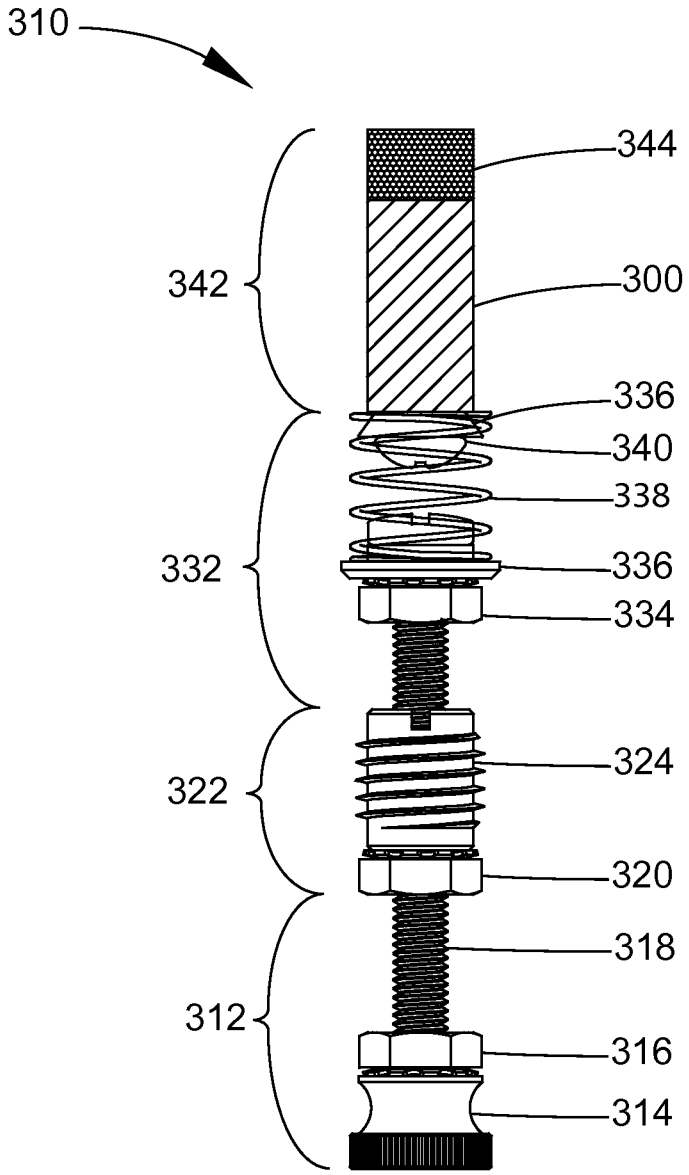
FIG. 18 is a detailed side view, partially in section, of the lift rail spring assembly of FIG. 17.

Referring to FIGS. 17 and 18, the lift rail spring assembly 310 consists of four portions: a knob portion 312, a keybed embedded portion 322, a keybed recess portion 332, and a lift rail portion 342. An assembly hole 219 at the base of the assembly countersink 217 of the keybed 216 fixedly receives a threaded insert 324. A machine screw 318 is threaded through the threaded insert 324 in the assembly hole 219, such that the machine screw 318 extends both below the keybed 216 and above, within the assembly countersink 217. A user, wishing to adjust the relative lifting force of the lift rail 300, loosens locknut 320, advances or retracts the adjustment knob 314 (secured by locknut 316) attached to a bottom end of the machine screw 318, and then re-tightens locknut 320. Advancing or retracting the machine screw 318 (i.e., relative to threaded insert 324 and locknut 320) changes the position of the machine screw 318 relative to the keybed 216. For example, advancing the machine screw 318 causes the machine screw 318 to move upwards, along with the components of the keybed recess portion 332 accommodated in the assembly countersink 217. The keybed recess portion 332 includes a compression spring 338 coaxially arranged about a screw 340 and resting at either end on a spring cap 336 (the spring cap 336 at the lower end being secured by locknut 334). The lift rail 300 rests against the upper spring cap 336, and supports the keys 210 above, which rest on a suitable cushioning material 344, such as a felt or foam piece at an upper surface of the lift rail 300.

The biasing properties of the spring 338 are chosen such that the spring 338 exerts a force sufficient to lift the combined weight of the lift rail 300 and the keys. The force exerted by the spring 338 causes the lift rail 300 to maintain contact with and push upwardly on the key 210, causing the key in turn to remain in close proximity to, or engagement with, the wippen assembly 250, and the hammer assembly 230.

A piano user or owner may elect to adjust the position of the lift rail 300 and/or the force exerted by the spring 338, e.g., when the piano 200 is manufactured, or at some later point during the life of the piano.

To adjust the key lifting assembly, the key lifting assembly is positioned to be sitting on the keybed 216 (not supported by the springs 338), with the lift rail 300 out of engagement with the bottom surfaces of the keys 210. The user then presses and holds the soft pedal 260, thereby lifting the hammer rest rail 270 and the hammers 235. Since the bridle straps 240 are tensioned, the wippen assemblies 250 are lifted along with the hammers 235, and the lost motion-producing gaps 249 appear. To close the gaps 249 between the capstans 211 and wippen assemblies 250, the user continues to hold the soft pedal 260 while turning the adjustment knobs 314 that control the embedded portion 322 of the lift rail 300 supporting the compression springs 338. Turning the adjustment knobs 314 raises the embedded portion 322, which raises and compresses the springs 338, which raises the lift rail 300. As the lift rail 300 is raised, it lifts the keys 210 and closes the gaps 249. While holding the soft pedal 260, the user continues to raise the lift rail 300 (by turning the knobs 314) until the gaps 249 under all 88 keys are closed. At this point, the lost motion gaps produced between the key capstans 211 and wippen assemblies 250 are gone.

Alternatively, to adjust the position of the lift rail 300 and/or the force exerted by the spring 338, a different protocol may be employed. In particular, from a position where the lift rail 300 is out of engagement with bottom surfaces of the keys 210, the user turns the adjustment knobs 314 located beneath the keybed to raise the spring rail assembly 310 upward (relative to the rail 300). When all the hammers 235 are observed to be lifted off the lift rail 300, the user then turns the adjustment knobs 314 in the opposite direction until the affected hammers are no longer lifted. The lock nuts are then retightened to secure the adjustment.

A number of implementations of the disclosure have been described. Nevertheless, it will be understood that various modifications may be made without departing from the spirit and scope of the invention. For example, other devices for lifting the wippen assemblies 250 and the piano hammers 235 as a unit when the soft pedal 260 is depressed are also within the scope of this disclosure. For example, bridle straps 240 that are relatively longer or shorter than is typical in the prior art and/or bridle wires 252 that are relatively longer or shorter than typical in the prior art may be employed. The distribution of mass in the piano wippen assemblies 250 may also be rearranged or otherwise modified in a manner to urge or favor movement of the piano wippen assemblies acting under the force of gravity to rotate in the forward throw direction (arrow T, FIG. 3). Alternatively, or in addition, other means, e.g. mechanical, magnetic, or electromechanical linkages or the like, may be employed to impart upward lifting, downward pushing, or rotational forces in a manner to cause the piano wippen assemblies 250 to move with the piano hammers when the soft pedal is depressed.

Although a lift rail 300 has been described, mechanisms that lift (or rotate) the rear segments 213 of the piano keys upward or push (or rotate) the forward segments of the piano keys (in front of the pivot) downward while the key is unplayed are also within the scope of this disclosure. For example, this can include one or more downward-pushing elements engaging the forward segment of keys 210, producing rotational motion about the pivot point, P (shown in FIG. 3), e.g. by engagement with upper surfaces of the keys, or by application of attractive or other forces to the forward or the rear segments of the keys, e.g., produced by light-weight magnets embedded in the keys, or electromagnetically attractive materials embedded in the keys for interaction with one or more magnetic elements in the keyframe 215 or keybed 216. Distribution of mass in the piano keys 210 may also be rearranged or otherwise modified, e.g. to shift the weight balance toward the front segments of the piano keys.

Figure 19:
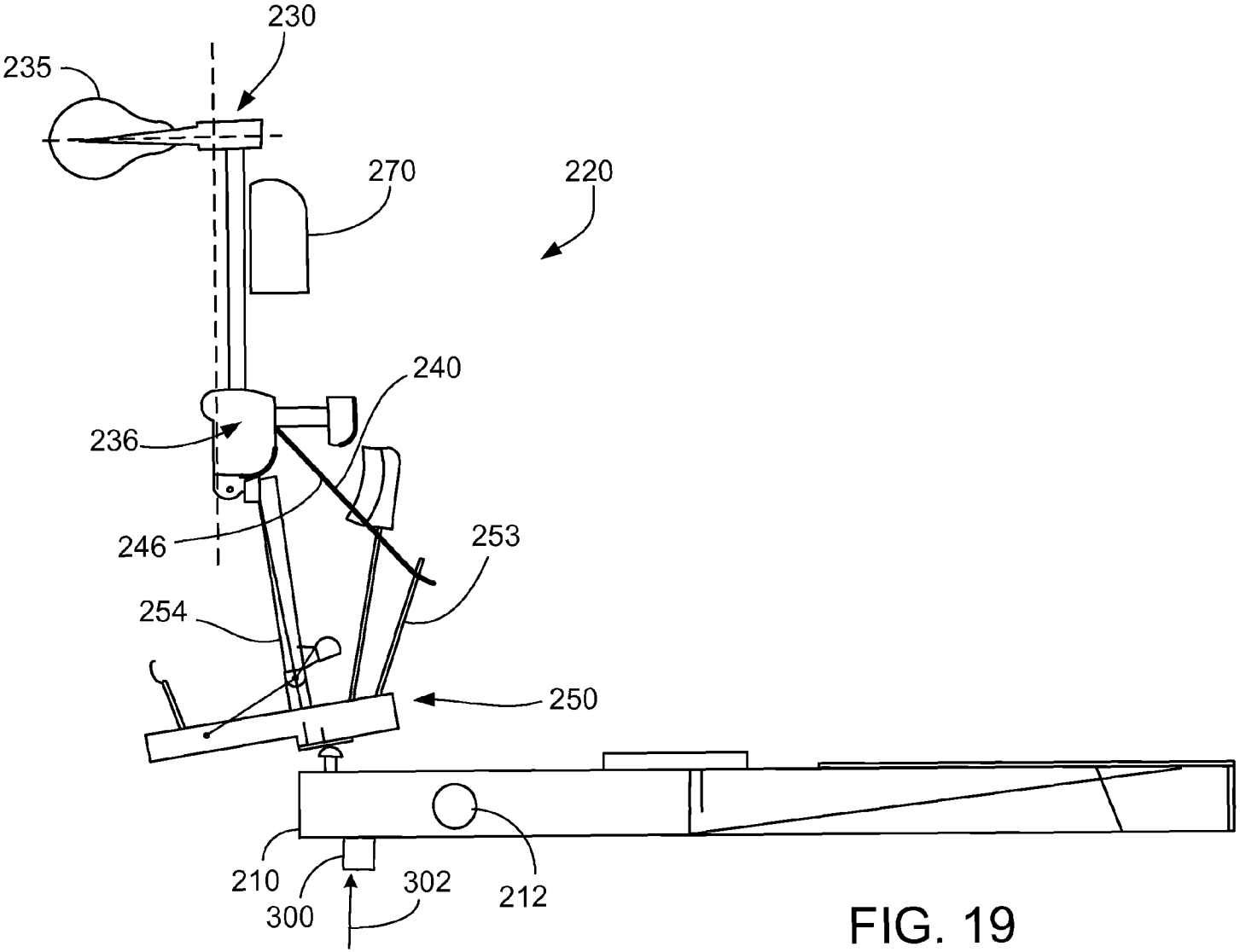
FIG. 19 is a detailed side view of an embodiment of the soft pedal piano action of FIG. 15C.
Figure 20A:
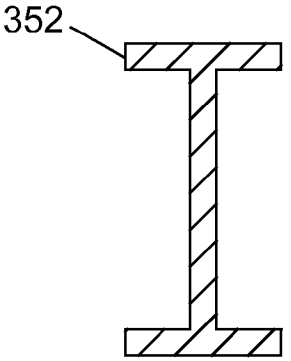
FIGS. 20A through 20J show alternative section views for the spring rail of the extended soft pedal piano action of FIG. 6A or FIG. 14.
Figure 20B:
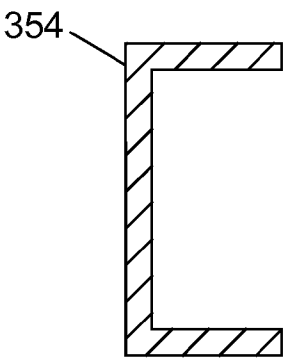
Figure 20C:
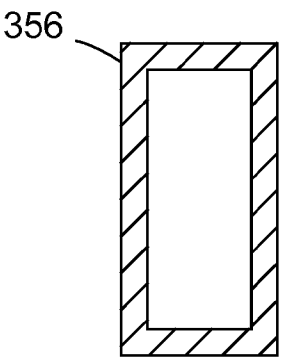
Figure 20D:
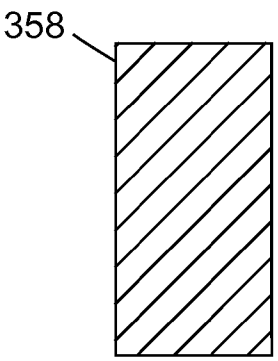
Figure 20I:
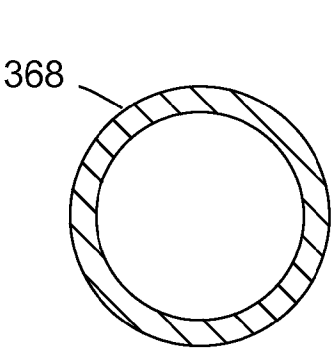
Figure 20E:
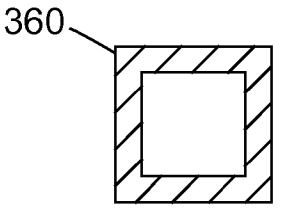
Figure 20F:
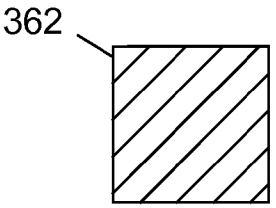
Figure 20G:
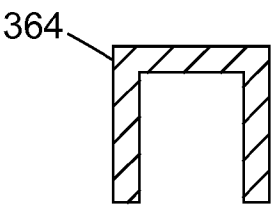
Figure 20H:
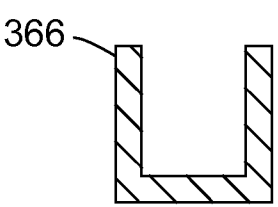
Figure 20J:
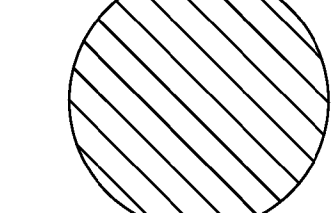

In another implementation, shown in FIG. 19, lost motion may be reduced by adjustment of positioning of the upper end portion of the bridle wire 253 to which the associated end of the bridle strap 240 is pinned, e.g. by bending the body or a portion of the body of the bridle wire 253 (typically towards the player), and/or by adjusting, e.g. lengthening or shortening, the body of the bridle wire 253.

The force exerted by the tensioned bridle strap 240 and bridle wire 252, in combination with the biasing force exerted by spring 338 when the piano is used in soft mode, can reduce or eliminate lost motion induced by separation of the elements of the piano key action. The soft pedal design of the present disclosure thus improves the normal mode of performance in the upright or vertical piano action by improving its touch characteristics to more closely resemble those of a grand piano.

In some implementations, combining one or more of the above-described techniques and devices can result in an upright piano with improved lost-motion characteristics. For example, in the implementation of FIG. 19, the bent bridle wire 253 with a relatively shortened bridle wire 252 and shortened bridle strap 240, and the lift rail 300 are all shown employed in the piano 200. However, it is recognized the variations of the span of the bridle strap 240 can result in differing reductions (improvements) in control of lost motion. For example, changes in the lengths of the bridle strap 240 and bridle wire 252, and the bend (angle) of the bridle wire 253 (in combination with the lift rail 300) can be optimized such that gaps are reduced to, or nearly to, 0 mm during both normal and soft pedal modes of play, resulting in a 100% reduction in lost motion sensation. In other implementations, the gap may be reduced to less than 3 mm, e.g., to less than 2 mm, or to less than or equal to 1 mm.

In the example shown in FIG. 15C, only the relatively shortened bridle wire 252, relatively shortened bridle strap 240, and lift rail 300 are employed. In a still further implementation, use of only a bent bridle wire 253 may reduce lost motion in normal mode by up to 60 or 70%, and use of a bent bridle wire 253 and a lift rail 300 may reduce lost motion by 60% to 70% in normal mode and in soft pedal mode.

In other implementations, the lift rail 300 may have suitable cross sections other than a rectangular bar. For example, as shown in FIGS. 20A through 20J, respectively, lift rail 300 may have a cross-section configured as an I-beam 352, a C-channel 354, a rectangular tube 356, a rectangular bar 358, a square tube 360, a square bar 362, an N-channel 364, a U-Channel 366, a round tube 368, round bar 370, or any other suitable configuration. The lift rail 300 may be formed of metal, plastic, wood, or other suitable material.

The rigid key lift rail 400 can have various cross sections as shown in FIGS. 20A-20J, and be formed of metal, plastic, wood, or other suitable material. Alternatively, rather than a separate rail, the rigid key lift rail 400 may be integrated into a back portion of the keybed 216. In this instance, a portion of the keybed 216 becomes a liftable surface.

In further implementations, the rigid lift rail 400 lift mechanism can include a sectional adjustment for adjusting the key lift rail height separately in different sections of the piano. For example, one long key lift rail base with three short key lift rail cap sections can each attached to the base with two screws. The heights and angles of the three caps could be adjusted independently.

In other implementations of a piano playable in at least a normal mode, and possibly, but not necessarily, selectively playable in a soft mode, a piano has a set of multiple bridle strap and bridle wire combinations. Each bridle strap and bridle wire combination connects a piano hammer to a corresponding piano wippen assembly, and the bridle strap and bridle wire combination are mounted and adjusted to maintain the hammer assembly and its corresponding wippen assembly together in gap-minimizing motion when an associated piano key is played.

In still other implementations of the pianos described above, for example, in instances where the piano is selectively playable in soft mode, as well as in normal mode, the piano may further include a soft pedal system, e.g. as has been described.

Accordingly, other implementations are within the scope of the following claims.

What is claimed is:

1. A piano selectively playable in a normal mode and in a soft mode comprises:

a set of multiple piano keys;

a set of multiple piano actions associated with said multiple piano keys, each said piano action including a piano wippen assembly actuated by depression of a corresponding said piano key;

a set of multiple piano hammers, each said piano hammer mounted for rotating movement and defining a forward throw direction toward at least one corresponding piano string, each said piano hammer being driven by a corresponding said piano wippen assembly to transfer force applied to an associated said piano key; and a soft pedal system comprising:

a soft pedal;

a hammer rest rail mounted for movement between a normal mode position with said set of multiple piano hammers disposed at rest at a spaced distance from corresponding piano strings, and a soft mode position with said set of multiple piano hammers moved into at rest positions relatively closer to the corresponding said piano strings;

a piano key lift rail mounted for movement between a normal mode position spaced from lifting contact with piano keys of said set of multiple piano keys and a soft mode position disposed in contact with and lifting said the piano keys along with said piano wippen assemblies; and a soft pedal linkage assembly in communication between said soft pedal and said hammer rest rail and said piano key lift rail, wherein actuation of said soft pedal causes movement of said hammer rest rail, along with said piano hammers, and causes movement of said piano keys, along with said piano wippen assemblies, between the normal mode position and the soft mode position, in gap-closing motion.

2. The piano of claim 1, wherein said soft pedal linkage assembly comprises:

a generally horizontal soft pedal trap lever, a hammer rest rail rod, and a piano key lift rail rod.

3. The piano of claim 2, wherein said hammer rest rail rod and said piano key lift rail rod are mounted in succession along said soft pedal trap lever.

4. The piano of claim 2, wherein said hammer rest rail rod and said piano key lift rail rod are mounted generally in parallel along said soft pedal trap lever.

5. The piano of claim 2, wherein actuation of said soft pedal lifts said hammer rest rail and said piano key lift rail.

6. The piano of claim 2, wherein said piano key lift rail rod comprises a linkage adjustable for length.

7. the piano of claim 6, wherein the linkage adjustable for length comprises a coaxial screw and a locking mechanism.

8. The piano of claim 6, wherein the linkage adjustable for length is independently adjustable relative to length of the hammer rest rail rod.

9. The piano of claim 1, wherein the piano key lift rail, upon actuation, is disposed in lifting engagement with a rear undersurface of piano keys of said set of multiple piano keys.

10. The piano of claim 1, wherein the piano key lift rail is mounted for pivoting movement between its normal mode position spaced from engagement with piano keys of said set of multiple piano keys and its soft mode position in lifting engagement with piano keys of said set of multiple piano keys.

11. The piano of claim 1, wherein said piano key lift rail is mounted at at least two pivot points.

12. The piano of claim 1, wherein the piano key lift rail is inflexible.

13. The piano of claim 1, wherein the piano key lift rail in soft play mode is positioned for movement into engagement with piano keys of said set of multiple piano keys by linear motion.

14. The piano of claim 1, wherein the piano key lift rail in soft play mode is positioned for movement into engagement with piano keys of said set of multiple piano keys by rotational motion.

15. The piano of claim 1, wherein the piano key lift rail engages piano keys of said set of multiple piano keys by spring force.

16. The piano of claim 1, wherein the piano key lift rail engages piano keys of said set of multiple piano keys by magnetic force.

17. The piano of claim 1, wherein the piano key lift rail engages piano keys of said set of multiple piano keys by electromechanical force.

18. The piano of claim 1, wherein each said piano action further comprises a piano hammer assembly, and said piano further comprises a set of multiple bridle strap and bridle wire combinations, each said bridle strap and bridle wire combination connecting a said piano hammer to a corresponding said piano wippen assembly, wherein actuation of the soft pedal tensions each said bridle strap and bridle wire combination to lift an associated said piano wippen assembly along with an associated said piano hammer assembly in the gap closing motion.

19. The piano of claim 18, wherein tensioning of at least one of said bridle strap and said bridle wire combinations comprises shortening at least one of the bridle strap and the bridle wire.

20. The piano of claim 18, wherein tensioning of at least one of said bridle strap and said bridle wire combinations comprises bending an upper end of the bridle wire below the bridle strap or by relocating the entire bridle wire.

21. The piano of claim 1, wherein each said piano action further comprises a piano hammer assembly, and said piano further comprises a set of multiple bridle strap and bridle wire combinations, each said bridle strap and bridle wire combination connecting a said piano hammer to a corresponding said piano wippen assembly, wherein said bridle strap and said bridle wire combination are mounted and adjusted to maintain said hammer assembly and said corresponding wippen assembly together in gap-minimizing motion when an associated said piano key is played in normal mode.

22. A piano playable in at least a normal mode comprises:

a set of multiple piano keys;

a set of multiple piano actions associated with said multiple piano keys, each said piano action comprising a piano hammer assembly and a piano wippen assembly actuated by depression of a corresponding said piano key;

a set of multiple piano hammers, each said piano hammer mounted for rotating movement and defining a forward throw direction toward at least one corresponding piano string, each said piano hammer being driven by a corresponding said piano wippen assembly to transfer force applied to an associated said piano key; and a set of multiple bridle strap and bridle wire combinations, each said bridle strap and bridle wire combination connecting a said piano hammer to a corresponding said piano wippen assembly, wherein said bridle strap and said bridle wire combination is mounted and adjusted to maintain said hammer assembly and said corresponding wippen assembly together in gap-minimizing motion when an associated said piano key is played.

23. The piano of claim 22, selectively playable in normal mode and in soft mode, further comprising:

a soft pedal system comprising:

a soft pedal;

a hammer rest rail mounted for movement between a normal mode position with said set of multiple piano hammers disposed at rest at a spaced distance from corresponding piano strings, and a soft mode position with said set of multiple piano hammers moved into at rest positions relatively closer to the corresponding said piano strings;

a piano key lift rail mounted for movement between a normal mode position spaced from lifting contact with piano keys of said set of multiple piano keys and a soft mode position disposed in contact with and lifting said piano keys along with said piano wippen assemblies; and a soft pedal linkage assembly in communication between said soft pedal and said hammer rest rail and said piano key lift rail, wherein actuation of said soft pedal causes movement of said hammer rest rail, along with said piano hammer assemblies, and causes movement of said piano keys, along with said piano wippen assemblies, between the normal mode position and the soft mode position, in gap-closing motion.

* * * * *

UNITED STATES PATENT AND TRADEMARK OFFICE

CERTIFICATE OF CORRECTION

PATENT NO. : 9,159,302 B2
APPLICATION NO. : 14/496578
DATED : October 13, 2015
INVENTOR(S) : Marvin Scott Jones, Sue Guan Lim and Susan Yake Kenagy It is certified that error appears in the above-identified patent and that said Letters Patent is hereby corrected as shown below:

On the Title Page, Item (54) and in the Specification, Col. 1, line 1, delete "PEDAL/CIP" and insert -- PEDAL --, therefor.

In the Claims

Col. 15, line 36, Claim 7, delete "the" and insert -- The --, therefor.

Signed and Sealed this
Twenty-eighth Day of June, 2016

Michelle K. Lee

Michelle K. Lee
*Director of the United States Patent and Trademark Office*